US008219004B2

(12) United States Patent
Mochizuki et al.

(10) Patent No.: US 8,219,004 B2
(45) Date of Patent: Jul. 10, 2012

(54) IMAGE FORMING APPARATUS

(75) Inventors: Shuichi Mochizuki, Osaka (JP); Tetsushi Ito, Osaka (JP); Hirotsugu Akamatsu, Osaka (JP); Kiyoshi Sasoh, Osaka (JP); Yuuji Kumagai, Osaka (JP); Tetsuya Yamaguchi, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 471 days.

(21) Appl. No.: 12/456,085

(22) Filed: Jun. 11, 2009

(65) Prior Publication Data

US 2009/0311007 A1 Dec. 17, 2009

(30) Foreign Application Priority Data

Jun. 13, 2008 (JP) ..... 2008-155681

(51) Int. Cl.
*G03G 15/00* (2006.01)

(52) U.S. Cl. ..... 399/167; 399/75

(58) Field of Classification Search ..... 399/167, 399/75

See application file for complete search history.

(56) References Cited

U.S. PATENT DOCUMENTS

| | | | | |
|---|---|---|---|---|
| 2003/0016965 | A1* | 1/2003 | Matsumoto | 399/167 |
| 2007/0110477 | A1* | 5/2007 | Handa et al. | 399/167 |

FOREIGN PATENT DOCUMENTS

| | | | |
|---|---|---|---|
| JP | 2001-117315 | A | 4/2001 |
| JP | 2002-244395 | A | 8/2002 |
| JP | 2005-189794 | A | 7/2005 |
| JP | 2006-259177 | | 9/2006 |
| JP | 2007-034147 | A | 2/2007 |
| JP | 2007-121555 | A | 5/2007 |
| JP | 2007-164136 | A | 6/2007 |
| JP | 2008-125247 | | 5/2008 |
| JP | 2008-134497 | A | 6/2008 |

* cited by examiner

*Primary Examiner* — David Gray
*Assistant Examiner* — Roy Y Yi
(74) *Attorney, Agent, or Firm* — Edwards Wildman Palmer LLP; David G. Conlin; Edmund J. Koundakjian

(57) ABSTRACT

An image forming apparatus including: a first and a second photoconductor groups constituted of one or more photoconductors respectively; a first and a second drive control sections for controlling the drive of the first and the second photoconductor groups respectively to rotate the photoconductors thereof, wherein the rotational phases of the first photoconductor group and the second photoconductor group are adjusted to be matched therebetween; and the first and the second drive control sections control so that predetermined profile of a target speed is applied to the first and second photoconductor groups wherein, in the target-speed profile, the first photoconductor group starts rotating after a elapse of a predetermined startup delay time from the second photoconductor group starts rotating, and both groups end at a same final speed predetermined for full-color image formation, wherein the startup delay time is predetermined based on measurements of times needed for each of the first and the second photoconductor groups to reach a predetermined speed from starting the rotation with the target-speed profile being applied thereto.

11 Claims, 18 Drawing Sheets

State in which phases are matched

State in which C photoconductor advances by σ

State in which C photoconductor delays by σ

IMAGE FORMING APPARATUS

CROSS-REFERENCE TO RELATED APPLICATION

This application is related to Japanese Patent Application No. 2008-155681 filed on Jun. 13, 2008, whose priority is claimed and the disclosure of which is incorporated by reference in its entirety.

BACKGROUND OF THE INVENTION

1. Field of the Invention

The present invention relates to an image forming apparatus having plural photoconductors.

2. Description of the Related Art

There has been known an image forming apparatus, so-called tandem type image forming apparatus, in which plural toner images are formed by means of plural photoconductors, each corresponding to each toner image, with an electrophotographic process, and these toner images are superimposed. In a tandem type image forming apparatus that forms a full-color image, toner images of respective color components, such as yellow (Y), magenta (M), cyan (C), and black (K), are formed by means of different photoconductors, and each of the toner images is superimposed (see, for example, Japanese Unexamined Patent Application No. 2006-259177).

In the tandem type image forming apparatus, it is necessary to drive the plural photoconductors, each corresponding to each toner image, and an image forming section for forming toner images onto the corresponding photoconductors. The number of components can be reduced by driving the photoconductors of Y, M, and C, which are simultaneously driven, and the corresponding image forming sections (including a developing unit) with a single motor in order to reduce the number of components in a drive section so as to downsize the apparatus. On the other hand, as for the black color, the K photoconductor and the K image forming section (including a K developing unit) are driven with a motor different from the motor used for the YMC, since the sections involved with the black color solely form an image during the formation of a monochromatic image. A stepping motor can be used, for example, as a motor for driving the photoconductors of the respective colors and the corresponding image forming sections. However, it is preferable to use a DC motor, which has a driving force per volume greater than that of the stepping motor, in order to drive a great number of loads, such as the loads for the YMC, with a single motor.

In a structure in which each of the photoconductors of the respective colors and the corresponding image forming sections are independently driven, there may be a case in which a capacity of the K developing unit is set to be greater than the capacities of the developing units for the other colors in order to make a frequency of an exchange of the K developing unit equal to that of the developing units for the other colors, since the K developing unit is more frequently used for the monochromatic printing than the other colors. In this case, a DC motor having a great driving force is preferable. A DC motor may sometimes be used for the other colors in order to share a control circuit and a control program with K. However, the problems described below arise when the DC motor is used for the drive.

Specifically, each of the photoconductors has a very small eccentricity due to a processing precision or assembling precision of components. This eccentricity produces a speed irregularity, which agrees with the rotating cycle, in a peripheral speed. A banding (periodic occurrence of coarse portions and fine portions) is produced due to the speed irregularity. When the high-density portions (fine portions) and the low-density portions (coarse portions) in the respective toner images are different in case where the toner images having the banding are superimposed, a color misregistration occurs, and this color misregistration is noticeable. In view of this, in order to match the high-density portions and the low-density portions in the respective toner images, the photoconductors are assembled with the rotational phase thereof adjusted. Further, the drive of each of the photoconductors is controlled so as to keep the adjusted rotational phase.

The control of the rotational phase is easy, if a stepping motor is used. However, when a DC motor is used, an increase curve of the speed of each of the YMC photoconductors and an increase curve of the speed of the K photoconductor during the period from when the respective photoconductors are started to when they reach a predetermined process speed might not be matched. This causes either the YMC photoconductors or the K photoconductor to rotate faster. Accordingly, a misregistration occurs in the rotational phases of the YMC photoconductors and the K photoconductor, before the YMC photoconductors or the K photoconductor reach the process speed.

This will be described in more detail. FIG. 10 is a waveform chart illustrating a speed control when photoconductor drums, which are stopped, are started by means of a DC motor serving as a driving source in a conventional image forming apparatus. In FIG. 10, an axis of ordinate indicates a target drive speed and an actual drive speed of the DC motor. An axis of abscissa indicates a time. At the time of starting the motor (time ts), the target value of the drive speed is set to an initial drive speed Vi upon the starting. The target speed is set to gradually assume a higher value with the lapse of time, and linearly increases to an image forming speed (process speed) Vf, which is determined beforehand for the image formation, at a time t4. One example of the process speed is 255 mm/sec in terms of the peripheral speed of the photoconductor drum. The diameter of the photoconductor drum is 30 mm, for example.

On the other hand, a transition state of an actual drive speed of the motor is as described below. The motor keeps stopped for a short while after the start of the motor. During this period, an output of a set comparing circuit 33 changes so as to gradually supply high current to the motor, since a misregistration from the target speed increases. Since the time has elapsed from the starting time ts to the time t0 when the motor starts to rotate, the target speed increases more than Vi. Thereafter, the driving force of the motor overcomes a static friction force, so that each motor starts to rotate at the time t0. The rotational speed sharply increases in order to follow the target speed. The drive speed of the K photoconductor reaches the target speed at the time t1. The target speed at this point is V1 that is greater than the initial drive speed Vi. On the other hand, the drive speeds of the YMC photoconductors reach the target speed at a time t2 because a load is heavier than that of the K photoconductor. The target speed at this point is V2. Because of a difference in a drive load between the YMC photoconductors and the K photoconductor, the K photoconductor increases more sharply than the YMC photoconductors. Therefore, the time taken to reach the target speed is different between the K photoconductor and the YMC photoconductors. In FIG. 10, a difference in the rotational phase, i.e., a difference in the rotational angle, occurs between the K photoconductor and the YMC photoconductors by a distance (the product of the speed and the time) corresponding to an area of an internal region (a hatched region) enclosed by lines linking a point where the time is t0 and the target speed is zero, a point where the time is t1 and the target speed is V1, and a point where the time is t2 and the target speed is V2.

As for a control upon the starting of each photoconductor, there has been known an apparatus in which a start timing of each photoconductor is adjusted so as to allow rotational phases of a plurality of photoconductors to match with one another (see, for example, Japanese Unexamined Patent Application No. 2006-259177). The technique disclosed in Japanese Unexamined Patent Application No. 2006-259177 is not to suppress the generation of the misregistration in the rotational phases, but to detect and adjust the phase of each photoconductor in order to correct the misregistration after the generation with acceptance on the generation of the misregistration. Further, the technique needs to employ an absolute-type rotary encoder, which is expensive, for the detection of the phase.

In view of this, a technique capable of detecting the misregistration of the rotational phases without using a complicated and expensive detecting mechanism has been demanded. If the misregistration is quickly compensated when the misregistration in the phases occurs, the situation in which an apparatus is operated with the phases greatly misregistered can be avoided. A technique for realizing the compensation described above has been demanded.

SUMMARY OF THE INVENTION

According to the finding of the inventors, the misregistration amount in the rotational phase caused upon the start of the motor increases as a difference of a load between the motors is great. This is considered that the inconsistency between an increase curve of the speed of the YMC motors and an increase curve of the speed of the K motor upon the starting increases. When the YMC photoconductors and the corresponding image forming sections are driven by a single motor, a difference in a load between the motor for the YMC photoconductors and the corresponding image forming sections and the motor for the K photoconductor and the K image forming section increases compared to a case of driving each color of YMC with a separate motor, whereby the misregistration in the rotational phase is likely to occur upon the start. This is non-preferable from the viewpoint of preventing the color misregistration.

The present invention is accomplished in view of the circumstance described above, and aims to provide a technique for compensating a rotational phase of each photoconductor without using a complicated and expensive detecting mechanism so as to be capable of suppressing a color misregistration caused by a misregistration in rotational phases, in an image forming apparatus including plural photoconductors, each forming an image that is to be superimposed. In other words, a misregistration in a rotational phase, which is caused upon starting a photoconductor driven by a first drive section and a photoconductor driven by a second drive section after they are stopped, can be prevented.

The present invention provides an image forming apparatus including: a first photoconductor group constituted of one or more photoconductors for forming a mono-color image; a second photoconductor group constituted of one or more photoconductors for forming a full-color image together with the first photoconductor group; a first drive section for driving the first photoconductor group to rotate the photoconductor (s) thereof; a second drive section for driving second photoconductor group to rotate the photoconductor(s) thereof; a first drive control section for controlling the first drive section; and a second drive control section for controlling the second drive section, wherein each photoconductor constituting the first and the second photoconductor groups is engaged to the corresponding drive section thereto with rotational phases being matched with one another; the rotational phases of the first photoconductor group and the second photoconductor group are adjusted to be matched therebetween; the first and second drive control sections control the first and second drive section so that predetermined profile of a target speed is applied to the first and second photoconductor groups wherein, in the target-speed profile, the first photoconductor group starts rotating after a elapse of a predetermined startup delay time from the second photoconductor group starts rotating, and both groups end at a same final speed predetermined for full-color image formation, wherein the startup delay time is predetermined based on measurements of times needed for each of the first and the second photoconductor groups to reach a predetermined speed from starting the rotation with the target-speed profile being applied thereto.

In the image forming apparatus according to the present invention, the drive control section controls so that the first drive section is started after a lapse of a predetermined startup delay time after the second drive section is started, when each of the photoconductors is started to, wherein the startup delay time is predetermined based on the result of the counted time of the first and the second drive sections. Therefore, the rotational phase of each photoconductor can be compensated without employing a complicated and expensive detecting mechanism, whereby a color misregistration caused by a misregistration in rotational phases can be prevented. Specifically, upon the starting, the drive section, which starts the first photoconductor group, is driven a predetermined time after the start of the rotation by the drive section that drives the second photoconductor group, which has a greater load. Accordingly, the misregistration in the rotational phases due to the difference in the loads can be reduced.

DETAILED DESCRIPTION OF THE PREFERRED EMBODIMENTS

Figure 1:
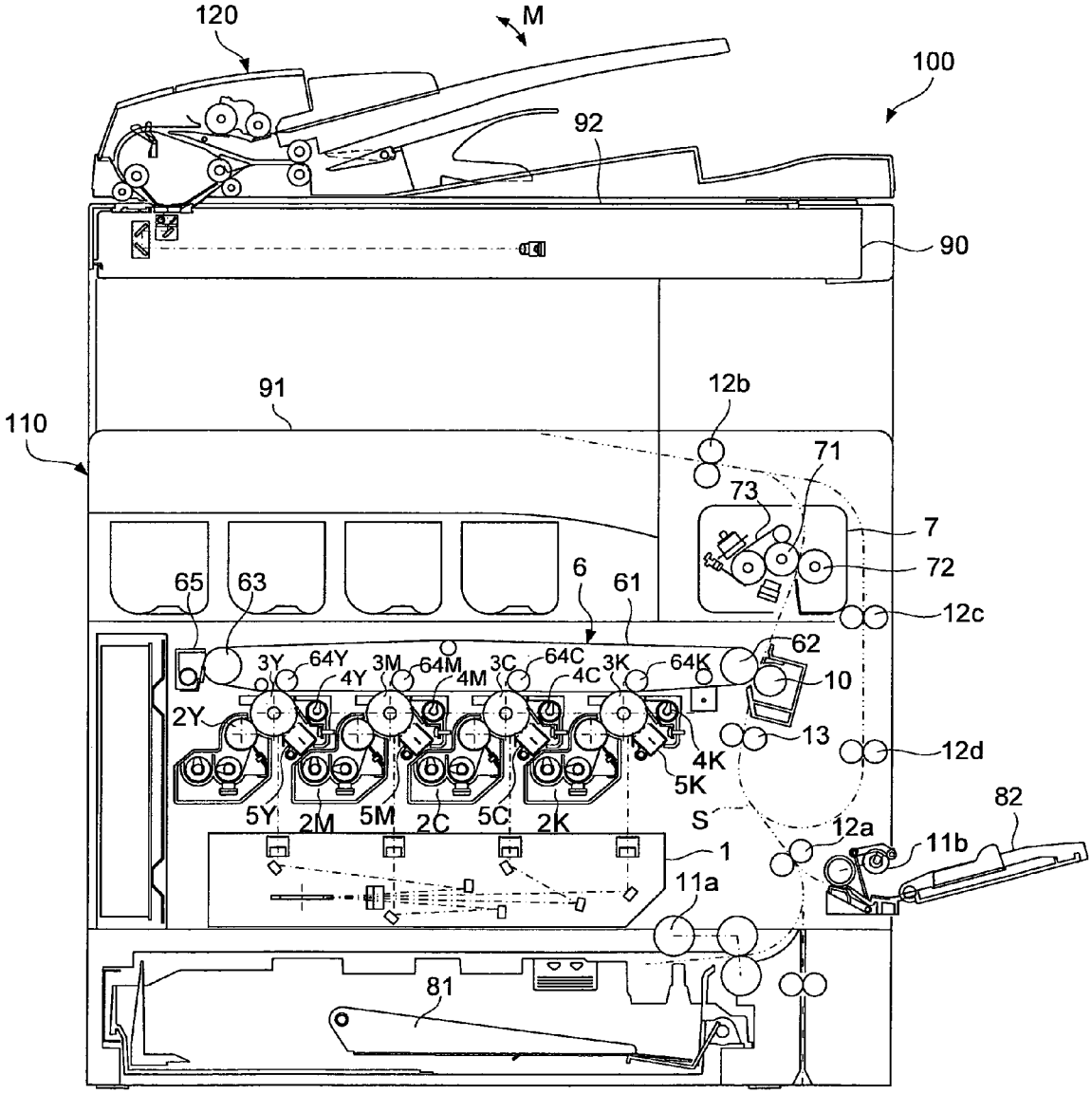
FIG. 1 is an explanatory view illustrating an outline of an image forming apparatus to which the present invention is applied.

In the present invention, a mono-color image is formed by using one or more color components, and further, formed by using color components less than those for a full-color image. When the mono-color image is formed by plural color components, a color phase of the image is substantially uniform in each region. In an embodiment described later, a mono-color image is constituted of only a K color component. Specifically, the first photoconductor group is constituted of only one photoconductor. This is a general embodiment. It is to be noted that there is an embodiment, for example, in which photoconductors are used for a high-density region and a low-density region since more emphasis is placed on a gray-scale. In the present invention, a mono-color means a single phase. It is not necessarily a black. For example, the mono-color may be red as a special use. In this case, two color components of Y and M correspond to the first photoconductor group. The first photoconductor group may be constituted of plural photoconductors as described above.

On the other hand, a full-color image is formed by using Y, M, C, and K color components in the later-described embodiment. The photoconductors for Y, M, and C correspond to the second photoconductor group. This is a general embodiment. In the case where the mono-color is red as described above, the photoconductors for C and K correspond to the second photoconductor group.

The first and the second drive sections drive the photoconductors. The specific embodiment thereof includes, for example, a mechanism for transmitting a drive from a drive source by means of a DC motor, a gear, a timing belt, or the like serving as the drive source.

The drive control section controls the start, stop and drive speed of the photoconductors driven by the first and the second drive sections. The specific embodiment thereof includes, for example, a control circuit of a motor and a CPU that gives an instruction to the control circuit.

One of the major features of the present invention is to compensate the misregistration in the phases, which is caused upon starting each photoconductor, by shifting the time when the drive control section starts to rotate each drive section by a predetermined startup delay time. The startup delay time is determined beforehand according to the measurement. The present invention does not need a complicated and expensive detecting mechanism. However, the phase misregistration may be detected by using a simple phase detecting mechanism, and the startup delay time may be corrected based on the detected phase misregistration. Instead of the correction based on the phase misregistration, or in addition to the correction based on the phase misregistration, the startup delay time may be corrected based on the cumulative rotating time of each photoconductor.

The image forming apparatus further includes, in addition to the photoconductors, the drive sections, and the drive control section, known mechanisms such as an image forming section, a superimposing section, a sheet feeding tray that stores print sheets, a second transfer section that transfers a toner image onto an intermediate transfer belt to the print sheet fed from the sheet feeding tray, a fixing section that fixes the toner image transferred onto the print sheet to the print sheet, etc.

The image forming section is arranged for forming the toner image onto a surface of the photoconductor. The image forming section includes each of a station involved with a charging, exposure, development, cleaning, and discharge, those of which are steps in an electrophotographic process.

The superimposing section transfers and superimposes the toner images onto the respective photoconductors. The specific embodiment thereof includes, for example, an endless intermediate transfer belt that moves as successively being contact with the respective photoconductors, and a drive mechanism that drives the intermediate transfer belt.

Preferable embodiments of the present invention will be described below.

In the image forming apparatus of the present invention, the predetermined speed may be the final speed The image forming apparatus of the present invention may further include: a phase detecting section for detecting the rotational phases of the first photoconductor group and the second photoconductor group; and a rotational phase correcting section for determining whether the matched rotational phases are maintained or not based on detection by the phase detecting section, and corrects the rotational phases of the first and/or the second photoconductor groups/group according to the determination thereof, wherein the phase detecting section may obtain misregistration in the rotational phases between the photoconductors when each of the photoconductors rotates with the final speed for the full-color image formation, and correct the startup delay time thereafter, based on the misregistration. With this configuration, the rotational phase is detected during when each photoconductor rotates with a predetermined speed for image-formation in order to obtain the misregistration, and the startup delay time is corrected based on the misregistration. Therefore, the misregistration in the rotational phases caused upon starting the photoconductors can correctly be compensated, whereby color misregistration can be prevented.

The image forming apparatus may further include a counting section for counting a cumulative rotating time of each photoconductor, wherein the first and second drive control sections may correct the startup delay time in accordance with the counted cumulative rotating time. In general, a magnitude of a drive load for a photoconductor depends upon a cumulative rotating time of the photoconductor. This is because the friction force between the photoconductor and a cleaning blade, which is exchanged together with the photoconductor, or the like, changes according to the cumulative value of the rotating time. According to this embodiment, the startup delay time can be corrected based on the cumulative rotating time of each photoconductor. Therefore, the misregistration in the rotational phases caused upon starting the photoconductors can correctly be compensated, whereby color misregistration can be prevented.

The first and the second drive control sections may control such that when the first and second photoconductor groups start rotating, an initial drive speed which is lower than the final speed is applied as the target speed, and after the speed of the first and the second photoconductor groups reaches the initial drive speed, the target speed is changed from the initial drive speed to the final speed, and the predetermined speed may be the initial drive speed. With this configuration, the image forming apparatus according to the present invention controls the drive of each photoconductor in which an initial drive speed lower than an image forming speed determined beforehand for an image formation is defined as a target speed upon the starting, and changes the target speed to the image forming speed from the initial drive speed to control the drive of each photoconductor after the speed of each of the photoconductors reaches the initial drive speed. Accordingly, the misregistration in the rotational phase caused upon starting the photoconductor driven by the first drive section and the photoconductor driven by the second drive section can be prevented. Specifically, since the target speed is set according to this embodiment, the correct rotational control can be done in order that the rotational phases of the photoconductors are not misregistered during the period from when the photoconductors reach the initial drive speed to when they accelerate to the speed for image-formation. On the other hand, the misregistration in the rotational phases during the period from when the photoconductors are started to when they reach the initial drive speed is compensated by the operation in which the drive control section allows the start of each drive section to be different from each other by a predetermined startup delay time as described above.

Accordingly, compared to the case in which the misregistration in the rotational phases caused in the period from startup of the photoconductors to a time of their reaching the speed for image-formation is compensated only by the startup delay time, the misregistration in the rotational phases can be more reduced. Compared to the case in which the rotational phases are controlled to be matched with one another only during the acceleration control after the photoconductors reach the initial drive speed, the present embodiment can avoid the situation in which a slight misregistration in the rotational phases, which are caused in the period from startup of the photoconductors to a time of their reaching the initial drive speed, becomes non-negligible every time the photoconductors are started to rotate. Therefore, the color misregistration can be prevented.

The first drive control section may control so that a rotational phase of the first photoconductor group at a time when the first photoconductor group starts rotating matches with a rotational phase thereof at a time when it stops rotating, when a mono-color image is formed. With this configuration, it is controlled such that the state in which the rotational phases of the photoconductors are adjusted can be maintained even after a mono-color image is formed.

The first photoconductor group may be constituted of a single photoconductor, while the second photoconductor group may be constituted of a plurality of photoconductors. With this configuration, a plurality of photoconductors are driven by the common drive section. Accordingly, the number of components of the drive section can be reduced, whereby the apparatus can be downsized and the cost can be reduced. Furthermore, the present invention can prevent the misregistration in the rotational phases caused when the photoconductors are started.

Each of the photoconductors may be used for forming a toner image of a different color component, the first photoconductor group may be used for forming a black toner image, and the second photoconductor group may be constituted of three photoconductors used for forming a yellow toner image, a cyan toner image, and a magenta toner image, respectively. With this configuration, the drive section is respectively provided to each of the YMC photoconductors that are simultaneously driven during the formation of a color image and the K photoconductor that is solely driven during the formation of a monochromatic image. Therefore, only the photoconductor used for forming a monochromatic image is solely driven, and the photoconductors that are simultaneously driven can be driven with the common drive section. The unnecessary sections can be stopped during the formation of a monochromatic image, whereby unnecessary power consumption can be suppressed, and the deterioration of consumable components can be suppressed. Moreover, the present invention can prevent the misregistration in the rotational phases caused when the photoconductors are started.

Alternatively, as a different embodiment, a second photoconductor group may be any one of a yellow photoconductor, a magenta photoconductor, or a cyan photoconductor. Specifically, in the structure in which the yellow photoconductor, the magenta photoconductor, and the cyan photoconductor are driven by the independent drive sections, any one of the photoconductors corresponds to the second photoconductor group, and the black photoconductor corresponds to the first photoconductor group.

Each of the first and the second drive sections may include a DC motor for driving the corresponding photoconductor group, respectively. With this configuration, it is possible to drive the photoconductor efficiently by using a DC motor, which has a driving force per volume greater than that of the stepping motor. Moreover, the present invention can prevent the misregistration in the rotational phases caused when the photoconductors are started.

The image forming apparatus may further include a plurality of image forming sections for forming toner images on the photoconductors, each of the image forming sections forming a toner image on different photoconductors, wherein the first drive section may drive image forming section(s) which forms/form the toner image(s) on the photoconductor (s) of the first photoconductor group and the second drive section may drive image forming section(s) which forms/form the toner image(s) on the photoconductor(s) of the second photoconductor group, and each of the image forming sections may include at least a developing section. With this configuration, the image forming section, particularly a developing section having a heavy load, is driven by the common drive section. Accordingly, the number of components of the drive section can be reduced, whereby the apparatus can be downsized and the cost can be reduced. Furthermore, the present invention can prevent the misregistration in the rotational phases caused when the photoconductors are started.

The rotational phase correcting section may detect whether the matched rotational phases are maintained or not at a predetermined timing, and allow the first and/or second drive control sections/section to correct the rotational phase of the first and/or second photoconductor groups/group when the rotational phase correcting section determines that the matched rotational phases are not maintained. With this configuration, when the misregistration occurs in the rotational phases of the photoconductors with the repeated operation of the start, rotation, and stop of the photoconductors, and the misregistration amount exceeds a predetermined allowable range and deviates from the allowable range from the state after the misregistration amount is adjusted, the misregistration is detected so as to allow the first and/or the second drive control sections/section to correct the rotational phases. Consequently, the rotational phases can be returned to the state after the adjustment, at least in the allowable range. Moreover, the present invention can prevent the misregistration in the rotational phases caused when the photoconductors are started. Accordingly, the frequency of the correction can be reduced more than in the conventional case.

The rotational phase correcting section may ignore the detections of the phase detecting section in the period from the starting of the first and the second photoconductor groups to their reaching the final speed and may determine whether the matched rotational phases are maintained or not based on the detections of the phase detecting sections after the reaching. With this configuration, the rotational phases can be detected in a state in which the photoconductors are driven with the image forming speed and the rotational phases of the photoconductors are stable. Accordingly, a correct determination can be done.

Various preferred embodiments described herein may be used in combination with one another.

The present invention will be described in detail below with reference to the drawings. It should be understood that the following description is illustrative of the invention in all aspects, but not limitative of the invention.

<Overall Structure of Image Forming Apparatus>

The overall structure of an image forming apparatus according to the present invention will be described first. Particularly, a photoconductor, an image forming section, and a superimposing section will be described.

FIG. 1 is an explanatory view schematically illustrating an image forming apparatus to which the present invention is applied. As illustrated in FIG. 1, an image forming apparatus 100 prints a multi-color or mono-color image onto a predetermined sheet (print sheet) in accordance with image data externally transmitted. The image forming apparatus 100 includes a body 110, an automatic document feeder 120, and a document reading section 90.

A document platen 92 made of a transparent glass on which a document is placed is mounted at an upper portion of the body 110. The document placed onto the document platen 92 is scanned and read by the document reading section 90. The automatic document feeder 120 transports the document onto the document platen 92. The automatic document feeder 120 is configured so as to be pivotable in a direction of an arrow M, whereby a document can manually be placed thereon by opening the document platen 92.

The body 110 includes an exposure unit 1, developing devices [developing units] 2 (2Y, 2M, 2C, 2K), photoconductor drums 3 (3Y, 3M, 3C, 3K), cleaner units 4 (4Y, 4M, 4C, 4K), chargers 5 (5Y, 5M, 5C, 5K), an intermediate transfer belt unit [intermediate-transfer-belt unit] 6, a fuser unit 7, a sheet feeding tray 81, a manual sheet-feeding tray 82, a sheet exit tray 92, and the like.

The image data handled by the image forming apparatus corresponds to a color image using colors of black (K), cyan (C), magenta (M), and yellow (Y). Therefore, four developing devices 2, four photoconductor drums 3, four charging devices 5, and four cleaner units 4 are provided so as to form four types of latent images corresponding to four colors. Each of these devices is set respectively to black, cyan, magenta, and yellow, whereby four image stations are formed. Any one of alphabets of Y, M, C, and K is attached at an end of the numerals in the figure.

The photoconductor drums 3 for the respective colors correspond to the photoconductor in the present invention. The charging devices 5, the developing devices 2 and the cleaner units 4 for the respective colors correspond to the image forming section in the present invention.

Each of the charging devices 5 is means for uniformly charging a surface of each of the photoconductor drums 3 with a predetermined potential. The illustrated charger type charging device, a contact roller type charging device or a brush type charging device may be employed.

The exposure unit 1 is configured as a laser scanning unit (LSU) including a laser emitting section and a reflection mirror. The LSU includes laser light-emitting elements, each of which emits a laser beam of Y, M, C, and K independently, a polygon mirror that reflects the laser beam emitted from each of the laser emitting elements to deflect the same, and an optical element (lens or mirror) for guiding the laser beam reflected by the polygon mirror to the photoconductor drums 3 of the respective colors. Instead of the LSU, the exposure unit 1 may be configured as an optical writing head having light-emitting elements such as EL or LED arranged in an array.

A peripheral surface of each of the photoconductor drums 3 charged by each of the charging devices 5 is scanned and exposed by the exposure unit 1 with patterns of the respective colors according to the inputted image data. With this exposure, an electrostatic latent image in accordance with the image data of each color is formed on the surface of each of the photoconductor drums 3. Each of the developing devices 2 makes the electrostatic latent image formed on the peripheral surface of each of the photoconductor drums 3 visible with toner. Each of the toner images, which are made visible, is transferred onto the later-described intermediate transfer belt 61 and superimposed with one another. Each of the cleaner units 4 removes and collects residual toner on the surface of each of the photoconductor drums 3 after the development and the image transfer.

The intermediate transfer belt unit 6 is arranged above the photoconductor drums 3. The intermediate transfer belt unit 6 includes an intermediate transfer belt 61, an intermediate-transfer-belt drive roller 62, an intermediate-transfer-belt driven roller 63, intermediate transfer rollers 64 (64Y, 64M, 64C, 64K), and an intermediate-transfer-belt cleaning unit 65. An intermediate transfer bias voltage is applied to each of the intermediate transfer rollers 64 for transferring the toner image onto the photoconductor drum 3.

The intermediate transfer belt unit corresponds to the above-mentioned superimposing section.

The intermediate transfer belt 61 is driven by the intermediate-transfer-belt drive roller 62 during the image formation, and is brought into contact with the photoconductor drums 3Y, 3M, 3C, and 3K, which simultaneously rotate, successively along a rotating direction. The toner images of the respective color components formed on the peripheral surfaces of the photoconductor drums 3 are superimposed and transferred, one by one, on the intermediate transfer belt 61. As a result, a color toner image (multi-color toner image) is transferred onto the intermediate transfer belt 61. The intermediate transfer belt 61 is an endless belt using a resinous film having conductivity with a thickness of about 100 to 150 μm, for example. The toner image that is superimposed and transferred onto the intermediate transfer belt 61 moves to a second transfer section where the intermediate-transfer-belt drive roller 62 and the transfer roller 10 are brought into contact with each other, and then, is transferred onto a print sheet, which is fed from the sheet feeding tray, at the second transfer section. A transfer bias voltage is applied to the transfer roller 10 for transferring the toner to the sheet.

The intermediate-transfer-belt cleaning unit 65 having a cleaning blade is provided for removing and collecting residual toner on a surface of the intermediate transfer belt 61 after the toner image is transferred at the second transfer section.

The sheet feeding tray 81 is provided below the exposure unit 1. The sheet feeding tray 81 stores sheets (print sheets) used for the image formation. The print sheet can be fed from the manual sheet-feeding tray 82. The sheet fed from the sheet feeding tray 81 and the manual sheet-feeding tray 82 passes through a sheet transporting path S having substantially a vertical shape to be discharged onto the sheet exit tray 91 provided at the upper portion of the body 110 through the transfer roller 10 and the fuser unit 7. Pickup rollers 11*a*, 11*b*, a transport roller 12*a*, a registration roller 13, the transfer roller 10, the fuser unit 7, and the transport roller 12*b* are arranged on a path from the sheet feeding tray 81 and the manual sheet-feeding tray 82 to the sheet exit tray 91 through the sheet transporting path S. Transport rollers 12*c* and 12*d* are arranged on a reverse path for a duplex printing that is parallel with the sheet transporting path S.

The pickup roller 11*a* picks up the sheet from the sheet feeding tray 81 one by one, and supplies the sheet to the sheet transporting path S. Similarly, the pickup roller 11*b* picks up the sheet from the manual sheet-feeding tray 82 one by one, and supplies the sheet to the sheet transporting path S. The registration roller 13 temporarily stops the sheet, which is transported through the sheet transporting path S, with the leading end thereof being in contact with the roller. Then, the registration roller 13 transports the sheet at a timing when the toner images formed on the photoconductor drums 3 and a position of the sheet are synchronized, and allows the sheet to pass through the transfer roller 10.

The fuser unit 7 includes a heat roller 71 and a pressure roller 72. The heat roller 71 and the pressure roller 72 transport the sheet transported from the transfer roller 10 as nipping the sheet. A temperature detector is arranged on a surface of the heat roller 71. Further, an external heating belt 73 for externally heating the heat roller 71 is provided. A control section, not shown, for controlling the operation of the image forming apparatus 100 controls a heater provided to heat the external heating belt 73 based on a signal from the temperature detector, in order to control the surface of the heat roller 71 to be a predetermined temperature. When the print sheet passes through the fuser unit 7, the multi-color toner image transferred onto the sheet is fused, mixed, and pressed to be fixed onto the sheet through an application of heat and pressure from the heat roller 71 and the pressure roller 72.

<Structure of Drive Section and Drive Control Section>

Next, a drive section and a drive control section for driving the photoconductor drums 3 of the respective colors and the developing devices 2 of the respective colors in the image forming apparatus 110 will be described.

Figure 2:
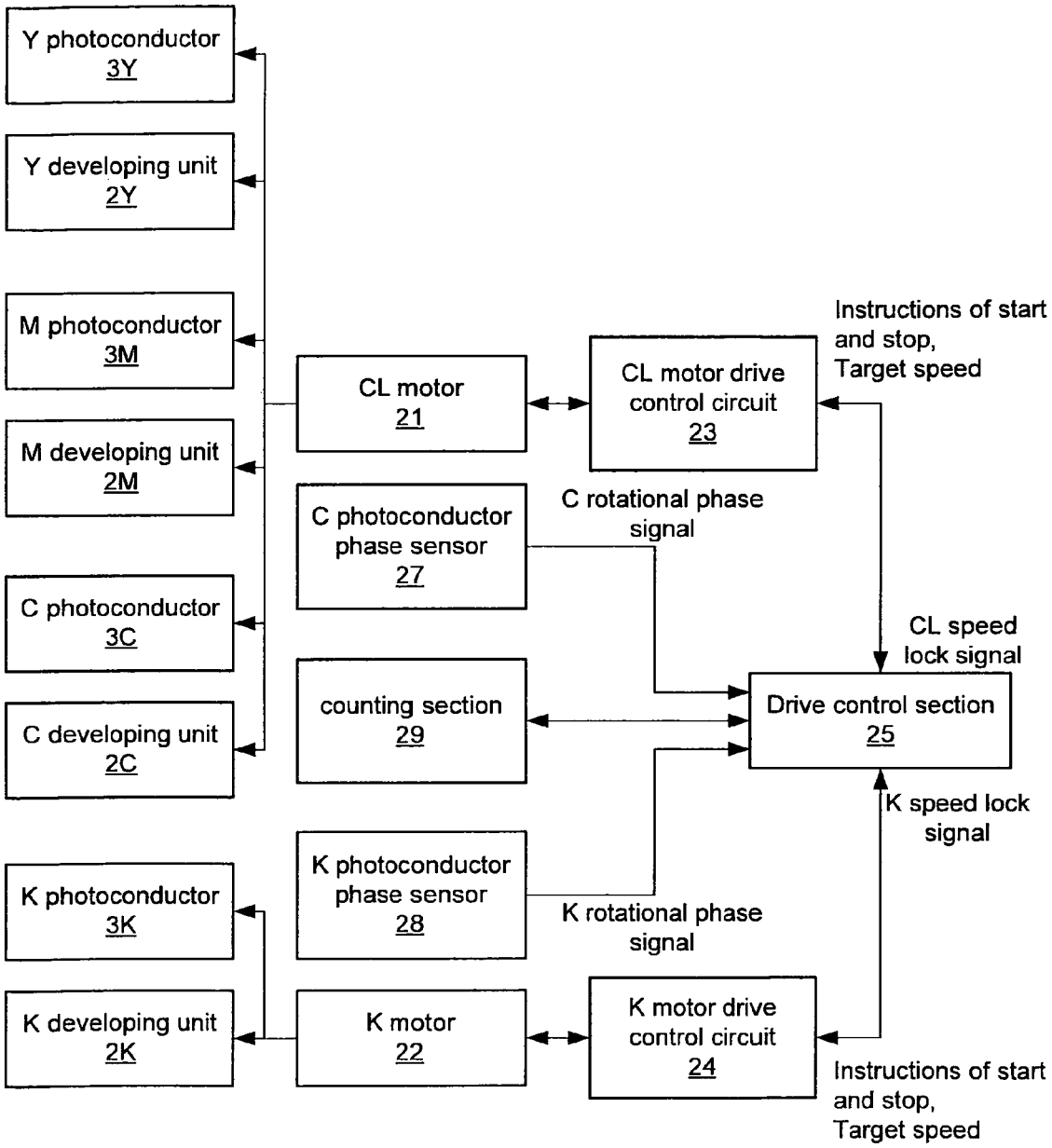
FIG. 2 is a block diagram illustrating a configuration of a drive section and a drive control section according to an embodiment of the present invention.

FIG. 2 is a block diagram illustrating the drive section and the drive control section according to an embodiment of the present invention. In FIG. 2, a CL motor 21 is a DC motor that drives the color photoconductors 3Y, 3M, and 3C and the color developing devices 2Y, 2M, and 2C. A K motor 22 is a DC motor that drives the black photoconductor 3K and the black developing device 2K.

The CL motor drive control circuit 23 controls the start, stop, and drive speed of the CL motor 21. The CL motor drive control circuit 23 is a servo control circuit that controls to agree the drive speed of the CL motor 21 with the target speed instructed from the drive control section 25. A K motor drive control circuit 24 controls the start, stop, and drive speed of a K motor 22. The K motor drive control circuit 24 is a servo control circuit that controls to agree the drive speed of the K motor 22 with the target speed instructed from the drive control section 25.

The drive control section 25 gives an instruction of start/stop of the CL motor 21 to the CL motor drive control circuit 23. During the image formation, the drive control section 25 gives an instruction to the CL motor drive control circuit 23 to drive the CL motor 21 with a predetermined process speed (a drive speed for the image formation). The drive control section 25 also gives an instruction of start/stop of the K motor 22 to the K motor drive control circuit 24. During the image formation, the drive control section 25 gives an instruction to the K motor drive control circuit 24 to drive the K motor 22 with the process speed.

The functions of the CL motor drive control circuit 23 and the drive control section 25 that gives an instruction to the CL motor drive control circuit 23, and the functions of the K motor drive control circuit 24 and the drive control section 25 that gives an instruction to the K motor drive control circuit 24 correspond to the second drive control section in the present invention.

A C photoconductor phase sensor 27 detects the rotational phases of the photoconductor drums 3Y, 3M, and 3C. A K photoconductor phase sensor 28 detects the rotational phase of the photoconductor drum 3K.

The counting section 29 is a block that counts the cumulative rotating times after the photoconductors 3Y, 3M, 3C, and 3K are exchanged. It includes a clock timer for counting time and a non-volatile memory that stores the counted time. Since the color photoconductor drums 3Y, 3M, and 3C have the common drive source, and they are simultaneously exchanged in general, the common value to YMC may be stored as the color cumulative rotating time. On the other hand, the photoconductor drum 3K sorely rotates during the monochromatic printing. Further, the period for exchange is different from that of the color photoconductor drums 3Y, 3M, and 3C. Accordingly, the cumulative rotating time of the K photoconductor drum 3K has to be stored independent of the cumulative rotating time of the color cumulative rotating time.

Figure 3:
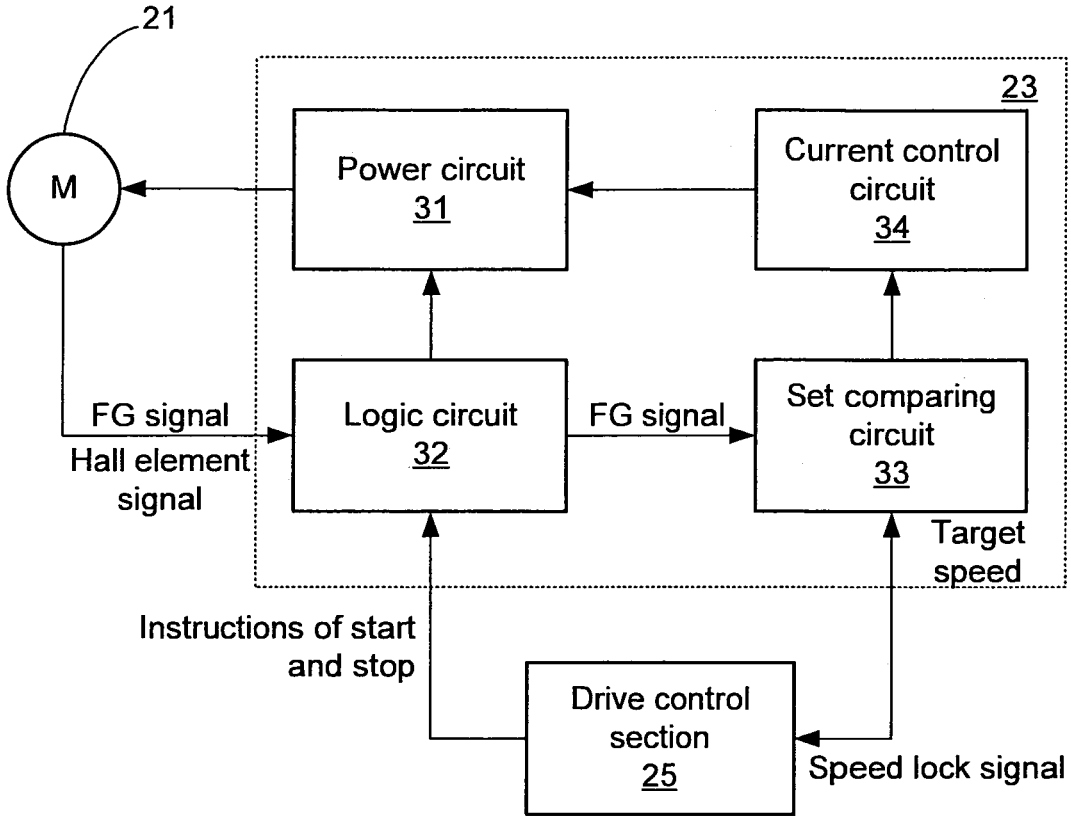
FIG. 3 is a block diagram illustrating a detailed configuration of a CL motor drive control circuit 23 shown in FIG. 2.

FIG. 3 is a block diagram illustrating a detailed configuration of the CL motor drive control circuit 23 shown in FIG. 2. As illustrated in FIG. 3, the CL motor drive control circuit 23 includes a power circuit 31, a logic circuit 32, a set comparing circuit 33, and a current control circuit 34. The CL motor in the present embodiment is a three-phase DC brushless motor.

The power circuit 31 is a bridge circuit that controls the current flowing through the winding of the motor. The power circuit 31 includes six switching transistors, i.e., two for one phase.

The logic circuit 32 receives a signal from a hall element arranged to the CL motor 21 in order to detect a rotating position of the rotor of the CL motor 21, and determines the order of the excitation of a motor winding, i.e., a pattern of on/off (switching) and a switching timing of the switching transistors in the power circuit 31. The logic circuit 32 also receives the instruction of the start and stop from the CL motor drive control circuit 23. It controls the switching of each of the transistors in accordance with the instruction. The logic circuit 32 also has a function of detecting the rotating speed of the CL motor 21. The CL motor 21 has incorporated therein a frequency generator (FG) for detecting the rotating speed. The logic circuit 32 detects the rotating speed based on a signal (FG signal) from the frequency generator.

The set comparing circuit 33 compares the target speed instructed from the drive control section and the FG signal indicating the rotating speed of the CL motor 21. Specifically, the set comparing circuit 33 compares whether the rotating speed of the CL motor 21 is faster than the target rotating speed or not. When the rotating speed of the CL motor 21 is higher than the target speed, the set comparing circuit 33 gives an instruction to the current control circuit 34 to reduce the input to the CL motor 21. When the rotating speed of the CL motor 21 is lower than the target speed, the set comparing circuit 33 gives an instruction to the current control circuit 34 to increase the input to the CL motor 21. When the rotating speed of the CL motor 21 agrees with the instructed target speed, the set comparing circuit 33 outputs a speed lock signal to the drive control section 25. The drive control section recognizes that the CL motor 21 rotates with the target speed from the speed lock signal.

The current control circuit 34 receives the instruction from the set comparing circuit 33, and controls the current flowing through the winding of the CL motor 21 by the power circuit 31.

The K motor drive control circuit 24 has the configuration same as that of the CL motor drive control circuit 23.

Next, a configuration of the drive mechanism that transmits the drive to the photoconductor drums 3Y, 3M, 3C, and 3K, which are loads, from the CL motor 21 and the K motor 22 serving as the drive source will be described. The drive mechanism constitutes the drive section in the present invention together with the motor serving as the drive source. The photoconductor-drum drive gears 41Y, 41M, 41C, and 41K belong to the photoconductors, since they rotate integral with the photoconductor drums 3Y, 3M, 3C, and 3K.

Figure 4:
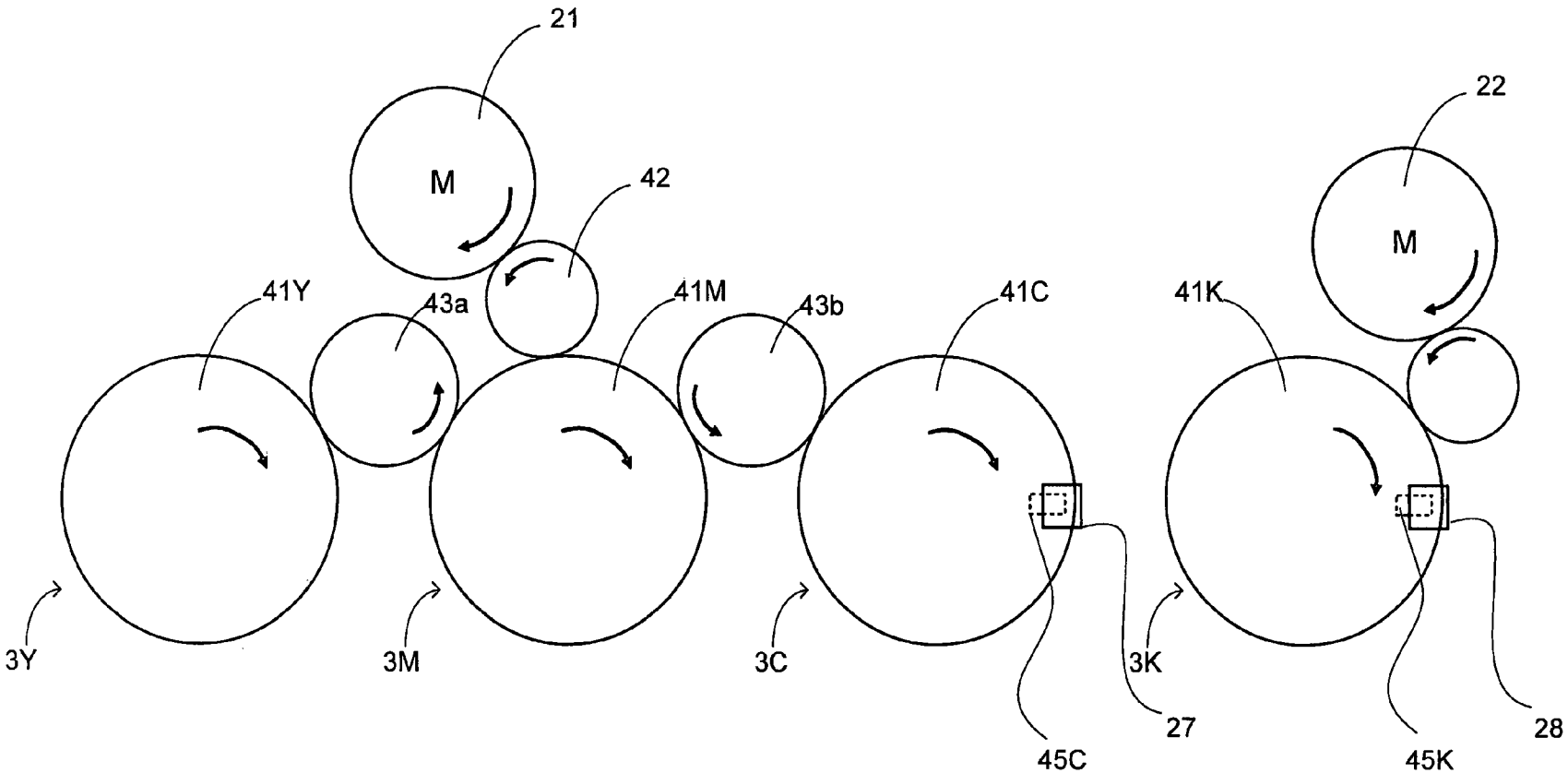
FIG. 4 is an explanatory view illustrating a configuration of a drive mechanism according to an embodiment of the present invention.

FIG. 4 is an explanatory view illustrating the configuration of the drive mechanism according to an embodiment of the present invention. In FIG. 4, a first end portion of each of the photoconductors 3 along the rotating direction is connected, through a coupling, to a rotational axis of each of drum drive gears 41Y, 41M, 41C, and 41K, which are arranged at the body 110 through a coupling. The drum drive gears 41Y, 41M, and 41C transmit a driving force to the photoconductor drum 3M from the drive gear fixed to the output shaft of the CL motor 21 through an input gear 42 and an idle gear. Further, the driving force is transmitted to the photoconductor drum drive gear 41Y from the photoconductor drum drive gear 41M through an idle gear 43*a*, and the driving force is transmitted to the photoconductor drum drive gear 41C from the photoconductor drum drive gear 41M through an idle gear 43*b*.

The C photoconductor phase sensor 27 is a photo interrupter type sensor for detecting the rotational phase of the photoconductor drum 3C. The photoconductor-drum drive gear 41C is provided with a projecting portion 45C at a position corresponding to the C photoconductor phase sensor 27. The projecting portion 45 C shields light of the C photoconductor phase sensor 27 per one rotation. In response to this, the C photoconductor phase sensor 27 outputs a C rotational phase signal. The K photoconductor phase sensor 28 is a photo interrupter type sensor for detecting the rotational phase of the photoconductor drum 3K. The photoconductor-drum drive gear 41K is provided with a projecting portion 45K at a position corresponding to the K photoconductor phase sensor 28. The projecting portion 45 K shields light of the K photoconductor phase sensor 28 per one rotation. In response to this, the K photoconductor phase sensor 28 outputs a K rotational phase signal.

In the present embodiment, the photoconductor drums 3Y, 3M and 3C are driven as coupled with one another with gears, so that the rotational phases are not misregistered during the drive. The eccentricity of each of the photoconductor-drum drive gears 41Y, 41M, and 41C greatly affects a banding in the toner image. However, the rotational phases of the gears are adjusted when the apparatus is shipped from a factory. Therefore, the rotational phase of the photoconductor drum 3C is detected as the representative of three photoconductor drums 3Y, 3M, and 3C. Then, the rotational phase is corrected between the photoconductor drum 3C and the photoconductor drum 3K. According to the present embodiment, the rotational phases of the photoconductor drums correspond to the rotational phases of the photoconductor-drum drive gears 41Y, 41M, and 41C.

Figure 11:
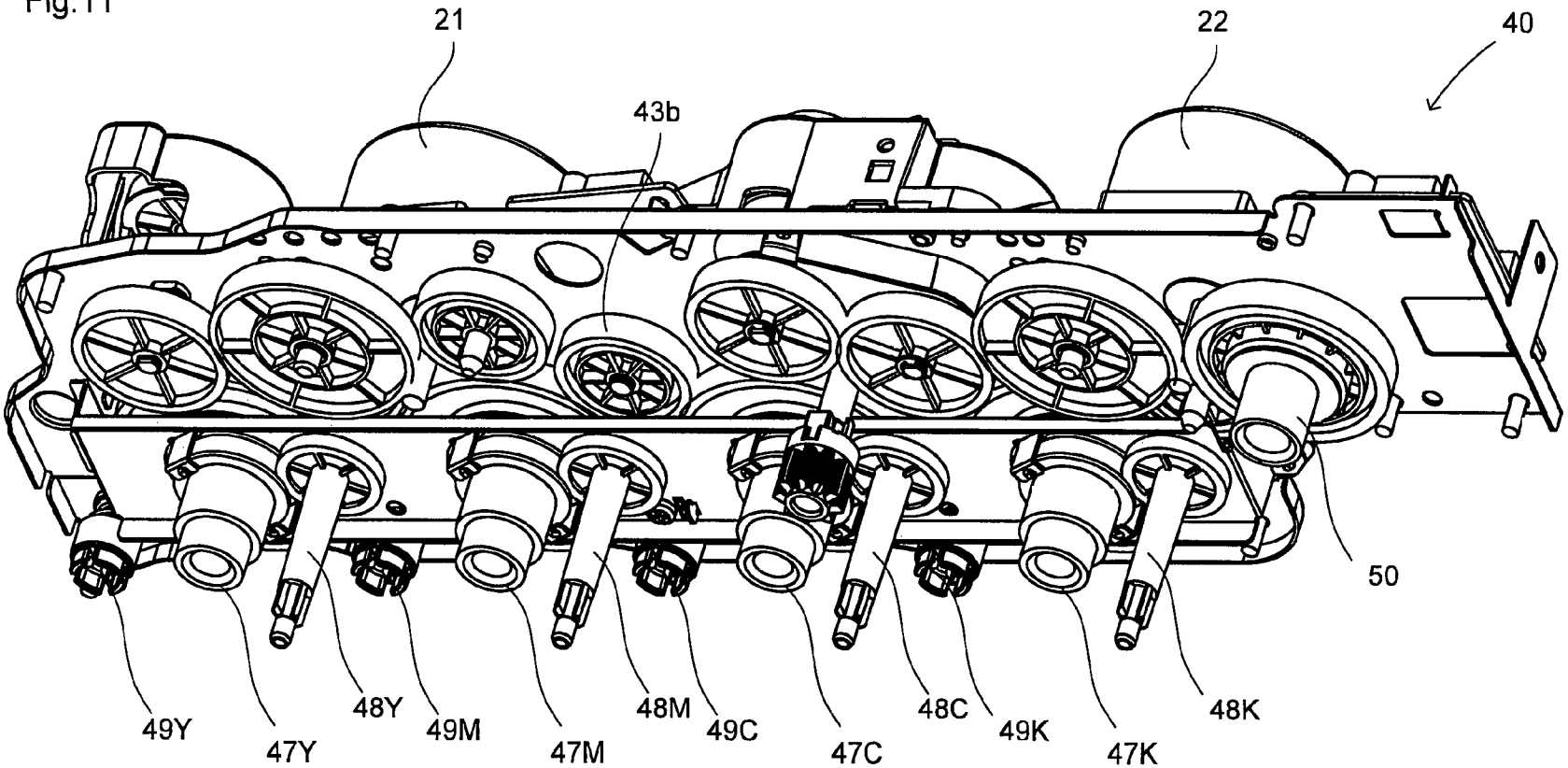
FIG. 11 is a perspective view illustrating a structure of a drive unit that is the drive mechanism shown in FIG. 4 formed into a unit.
Figure 12:
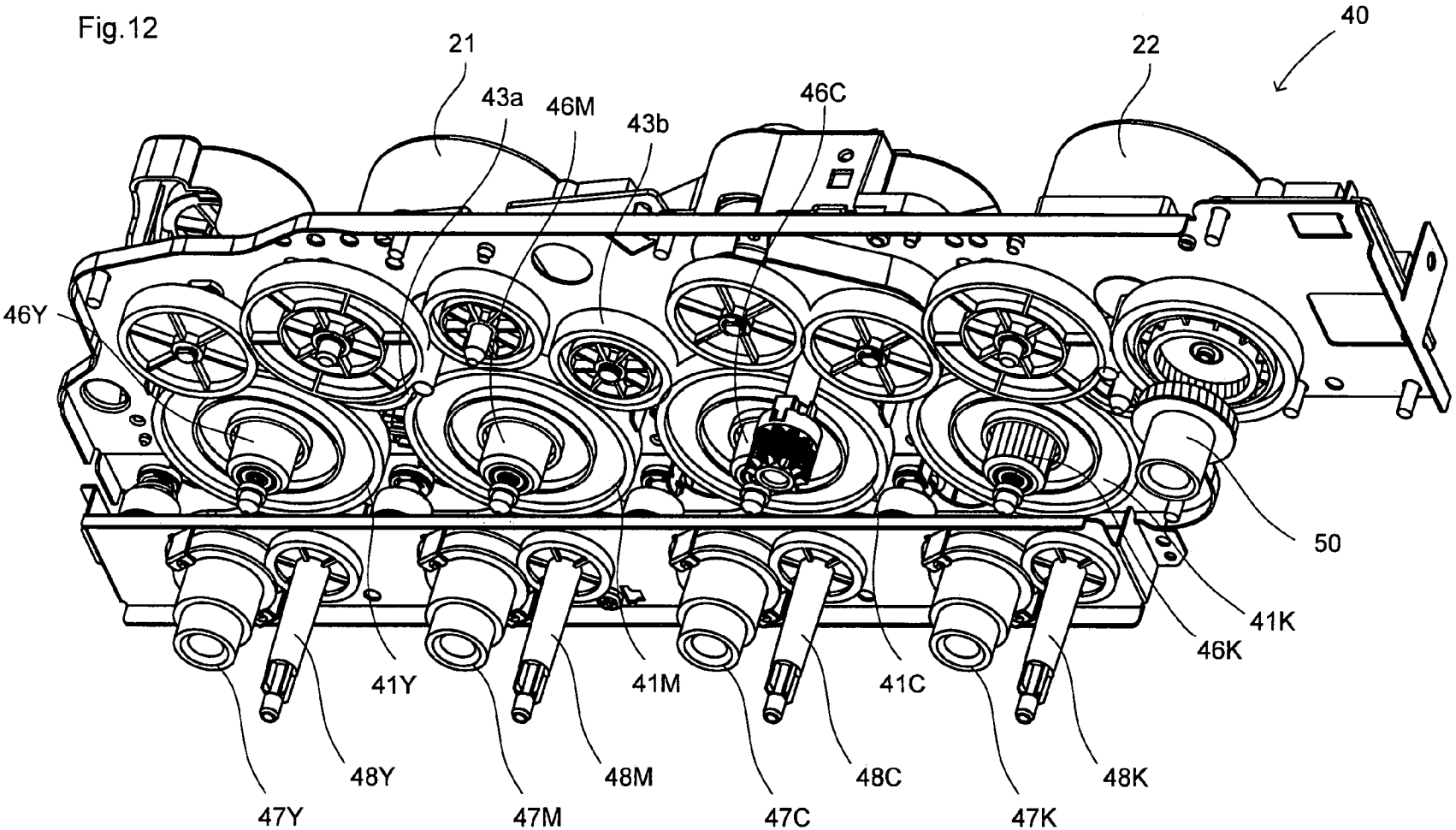
FIG. 12 is a perspective view illustrating a state in which each coupling is drawn in a near side in order to allow a user to see a photoconductor-drum drive gear in the drive unit shown in FIG. 11.

FIG. 11 is a perspective view illustrating a configuration of a drive unit in which the drive mechanism shown in FIG. 4 is made into a unit. FIG. 12 illustrates a state in which the couplings are drawn in the near side in order to allow a user to see the photoconductor-drum drive gears in the drive unit shown in FIG. 11. A photoconductor-drum drive shaft 46 is mounted at the center of each of the YMCK photoconductor-drum drive gears 41. A gear is formed at an outer peripheral surface at a leading end of the photoconductor-drum drive gear 46. A first end of each of the photoconductor-drum drive couplings 47 is fitted so as to cover the gear at the leading end. A gear is formed at an inner periphery of each of the photoconductor-drum drive couplings 47, which gear is lightly meshed with the gear at the leading end of the corresponding photoconductor-drum drive shaft 46, whereby the rotational drive of the photoconductor-drum drive shaft 46 is transmitted to the photoconductor-drum drive coupling 47. A second end of each of the photoconductor-drum drive couplings 47 is connected to the corresponding photoconductor drum 3.

A photoconductor-drum drive gear 54 is arranged at the first end of each of the photoconductor drums 3. The photoconductor drum 3 is made into a process unit 53 including the cleaner unit 4 and the charging device 5.

Figure 13:
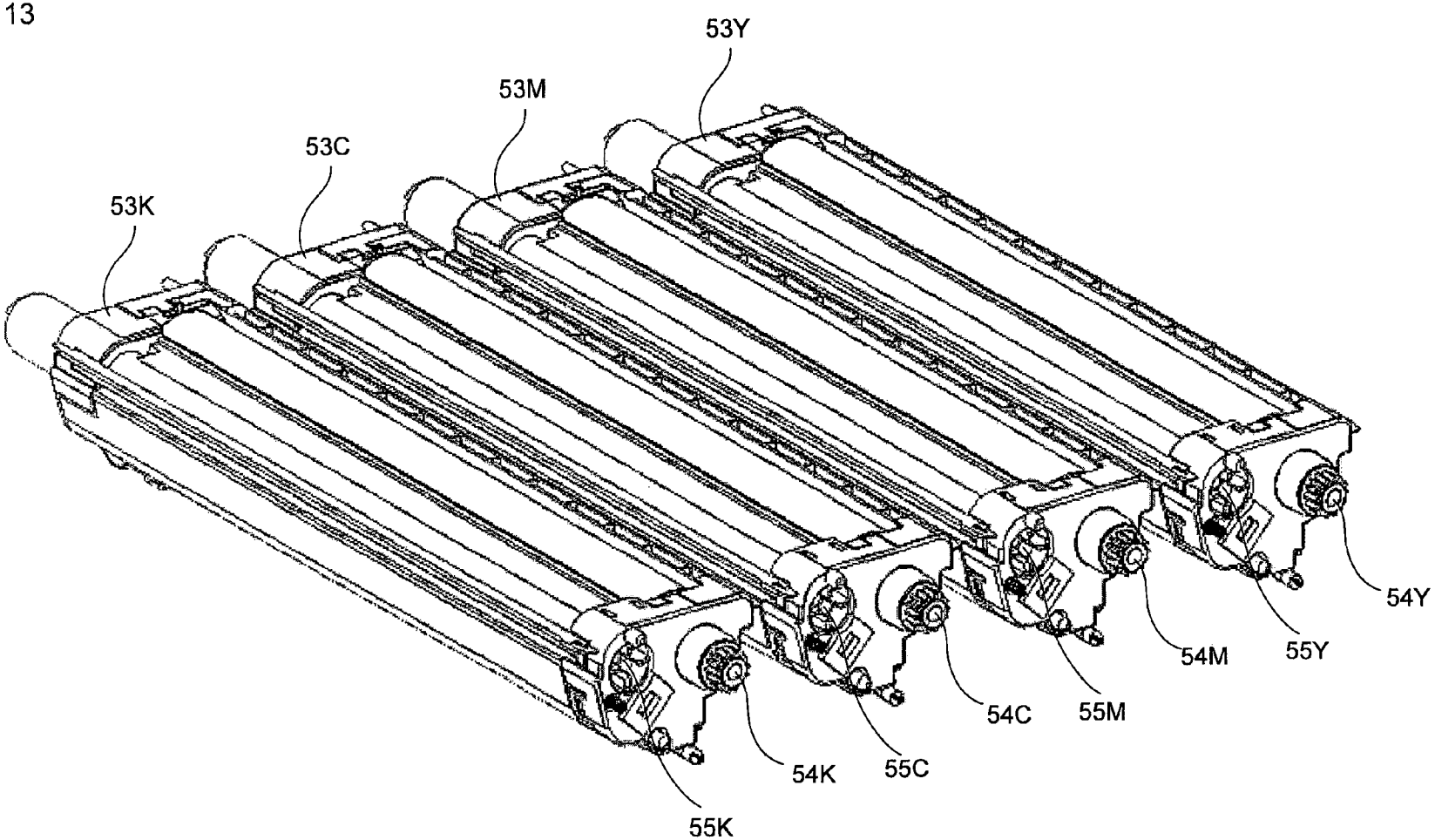
FIG. 13 is a perspective view illustrating a state in which each of process units of YMCK is arranged so as to correspond to the drive unit in an embodiment of the present invention.
Figure 14:
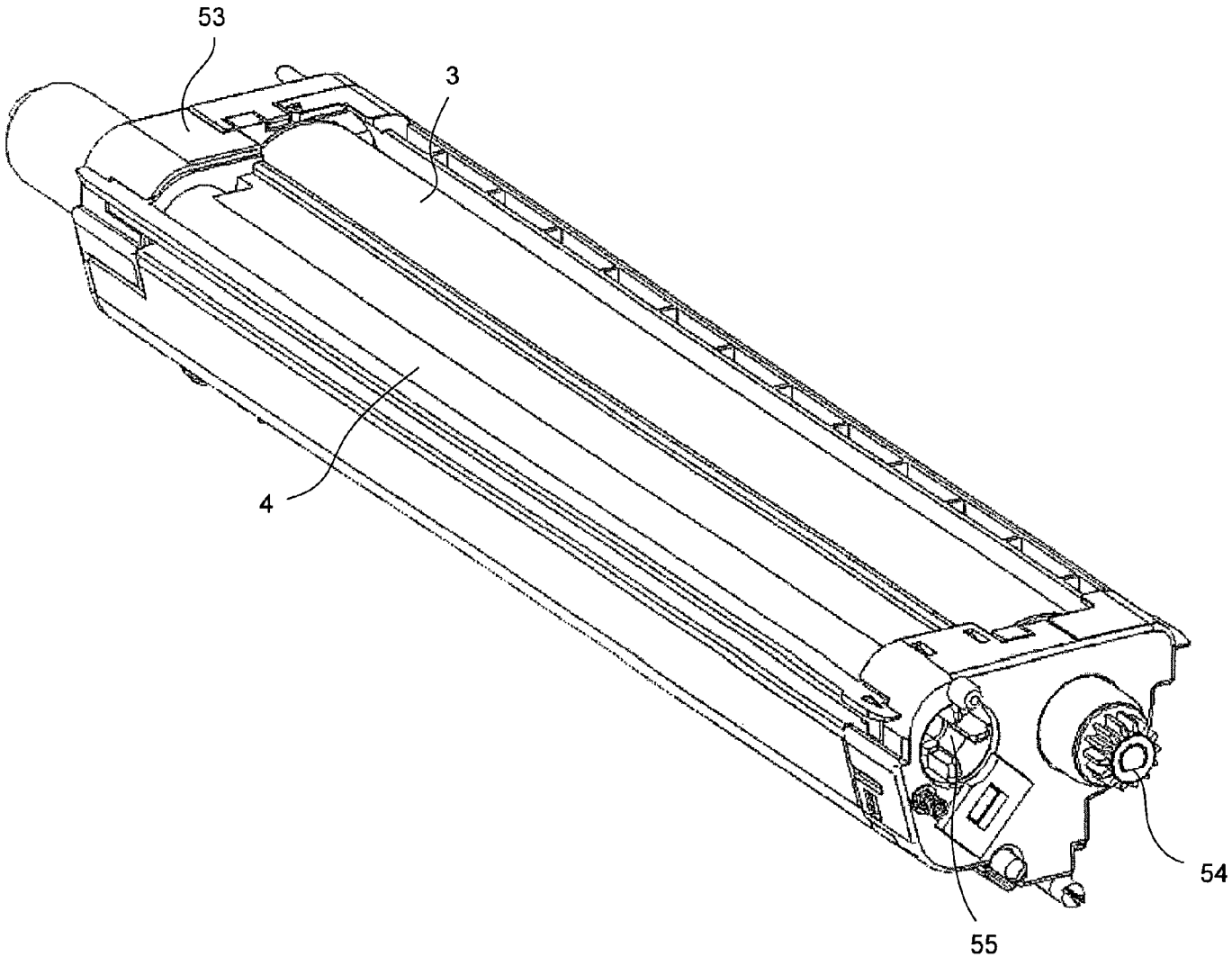
FIG. 14 is a perspective view illustrating an appearance of one of the process units shown in FIG. 13.

FIG. 13 is a perspective view illustrating a state in which each of the YMCK process units 53Y, 53M, 53C, and 53Y are arranged so as to correspond to the drive units 40. FIG. 14 is a perspective view illustrating an appearance of a single process unit. When each of the process units 53 is mounted to the body 110, each of the photoconductor-drum driven gears 54 is meshed with the gear formed on the inner periphery of each of the photoconductor-drum drive couplings 47. The rotational drive of each of the photoconductor-drum drive couplings 47 is transmitted to the photoconductor drums 3 via the photoconductor-drum driven gears 54.

The drive unit 40 also includes a cleaner drive coupling 48 that transmits drive to the cleaner unit 4, a developing drive coupling 49 that transmits drive to the developing device 2, and a transfer drive coupling 50 that transmits drive to the transfer roller 10. A cleaner driven coupling 55 that is engaged with the cleaner drive coupling 48 is provided to the process unit 53. The rotational drive transmitted to the cleaner driven coupling 55 rotates a waste toner transport screw provided in the cleaner unit 4.

Figure 7:
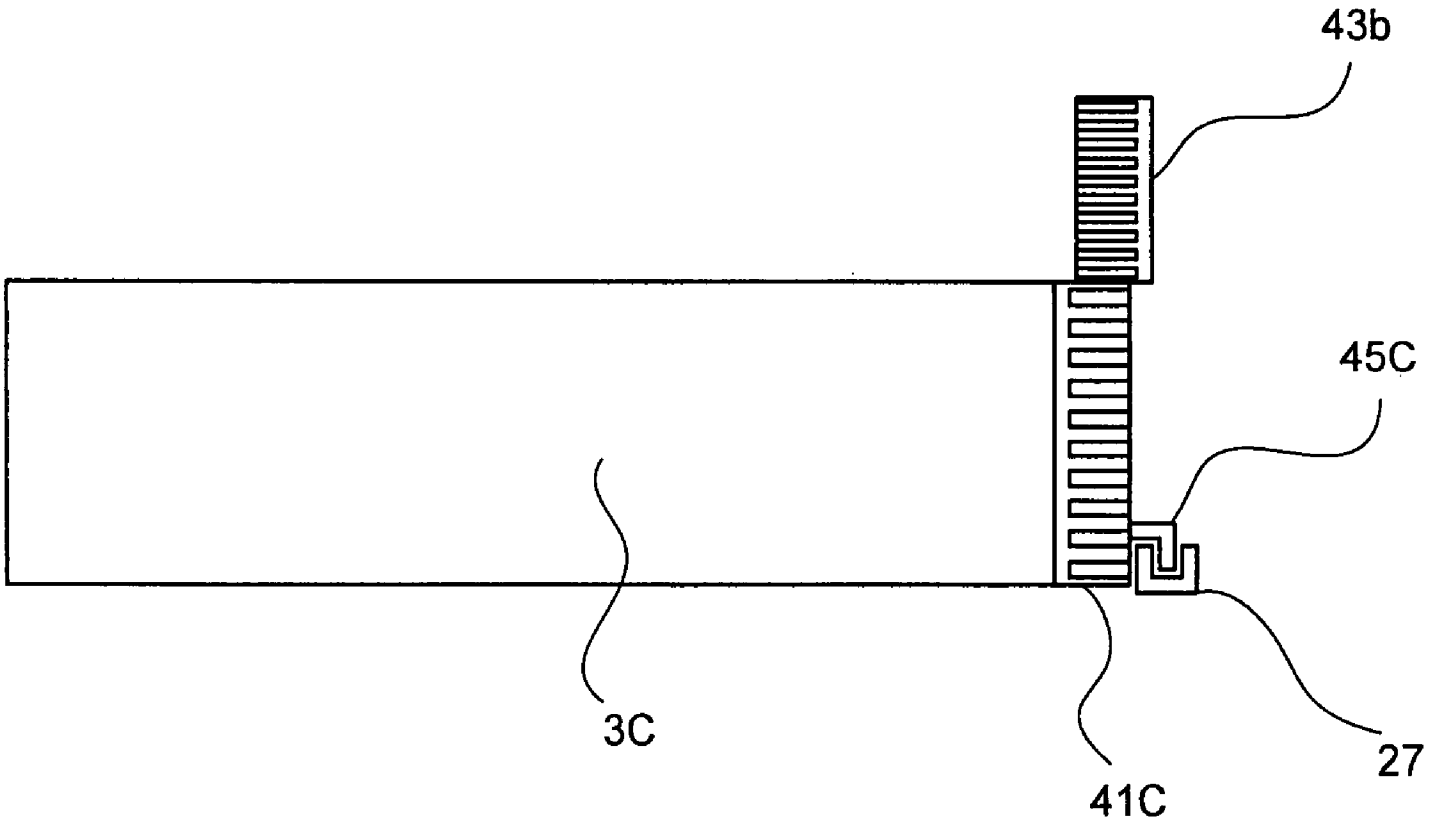
FIG. 7 is an explanatory view illustrating a configuration involved with a detection of a rotational phase of a photoconductor drum according to an embodiment of the present invention.

As illustrated in FIG. 7 described later, the drive mechanism may be configured as described below as a different embodiment. Specifically, each of drum drive gears 41 is fitted to the first end of each of the photoconductor drums 3 in an axial direction, and it is engaged with an input gear and an idle gear with the photoconductor drums 3 mounted to the body in order to transmit the driving force from the drive source. The photoconductor drums 3 for the respective colors are exchangeable components. However, since the drum drive gears 41 for the respective colors are exchanged with the photoconductor drums 3 for the respective colors in this embodiment, the rotational phase of each of the photoconductor drums 3 has to be adjusted after the exchange.

If the photoconductor drums 3Y, 3M, 3C, and 3K are driven by respective independent drive sources, and a photoconductor rotational phase sensor is provided for the respective colors in the configuration described above, the rotational phase of each of the photoconductor drums is detected after they are mounted, and the rotational phases thereof can be adjusted.

Since an unillustrated main control section, which controls the operation of each section in the image forming apparatus, autonomously executes a procedure described below, the rotational phases of the photoconductor drums 3 after the exchange can be adjusted without troubling a user. After the photoconductor drums 3 are exchanged, the main control section forms a pattern for adjusting the rotation, and transfers the formed pattern on the intermediate transfer belt 61. A reflection-type photo sensor used for the detection is arranged so as to be opposite to the intermediate transfer belt 61.

Figures 15A, 15B:
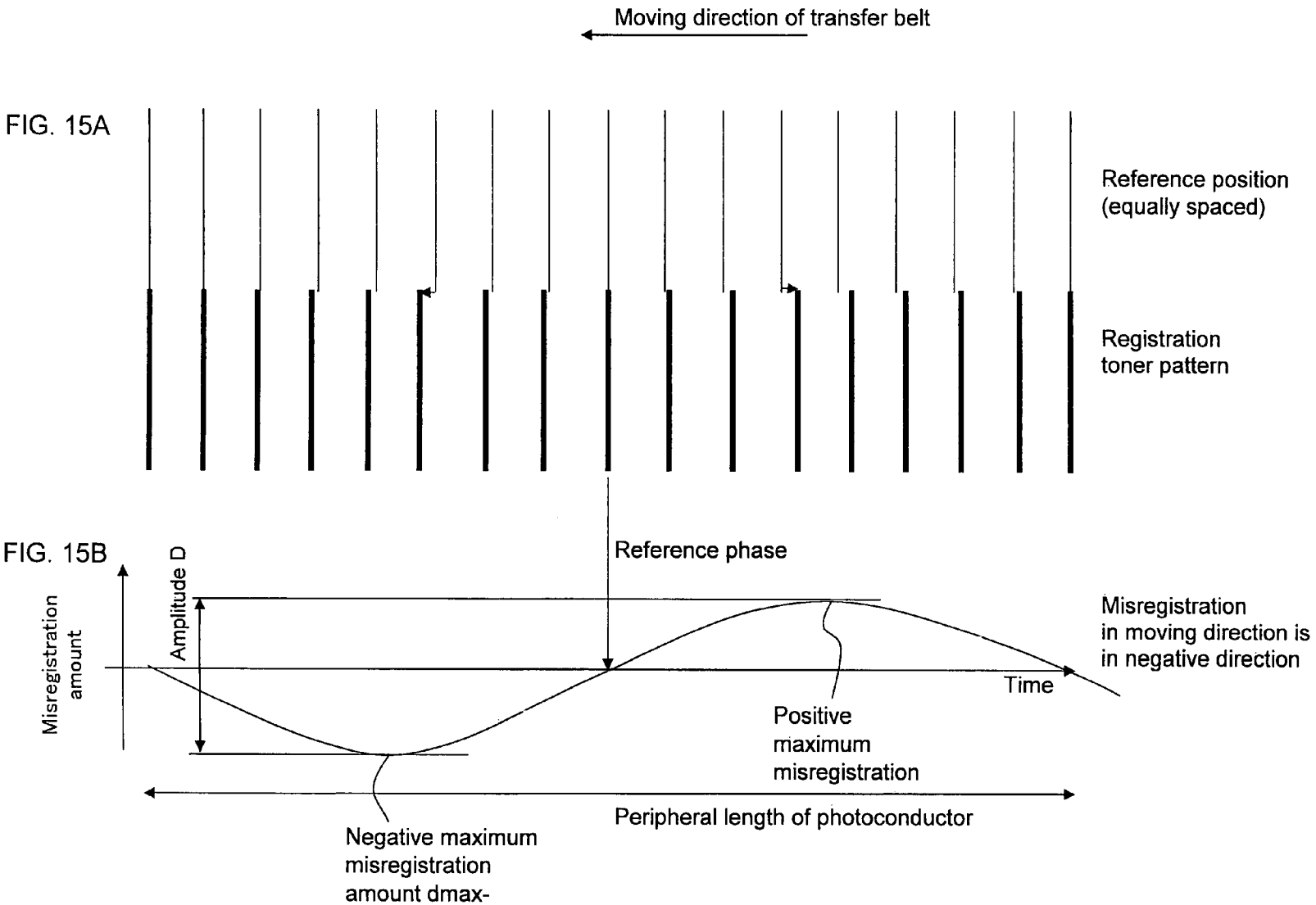
FIGS. 15A and 15B are explanatory views illustrating a pattern for adjusting the rotation in an embodiment of the present invention.

FIGS. 15A and 15B are explanatory views illustrating the pattern for adjusting the rotation. As shown in FIG. 15A, the pattern includes plural parallel lines that are orthogonal to an advancing direction of the intermediate transfer belt 61. An interval between the lines and the number of the lines in the pattern are set in such a manner that a period from when a first line passes through the photo sensor to when a last line passes through the photo sensor becomes substantially equal to the rotational cycle of the photoconductor drum 3. For example, the number of the lines is 17.

The main control section allows the photo sensor to detect the pattern transferred onto the intermediate transfer belt 61, and compares a detection timing of each line with each of reference timings so as to acquire a startup delay time or advance time of each line. When the acquired startup delay time or the advance time is plotted with respect to the time, the waveform having a sine wave caused by the eccentricity of the photoconductor drum 3 is ideally obtained (see FIG. 15B).

The main control section determines a line corresponding to the maximum startup delay time dmax− and a line corresponding to the maximum advance time dmax+, and determines a line closest to the middle of the respective lines as a reference phase line. This process is performed for the respective colors of Y, M, C, and K.

After the reference phase lines for the respective colors are determined, the control section determines the misregistration amount of the other reference phase lines (the reference phase lines of Y, M, and C) from the reference phase line of the reference color (e.g., K). The control section corrects the rotational phases of the photoconductor drums 3Y, 3M, and 3C based on the determined misregistration amount. The rotational phases are corrected when the photoconductor drums 3 are stopped. The correction of the rotational phase will be described in detail below.

<Speed Control by Drive Control Section>

Figure 5:
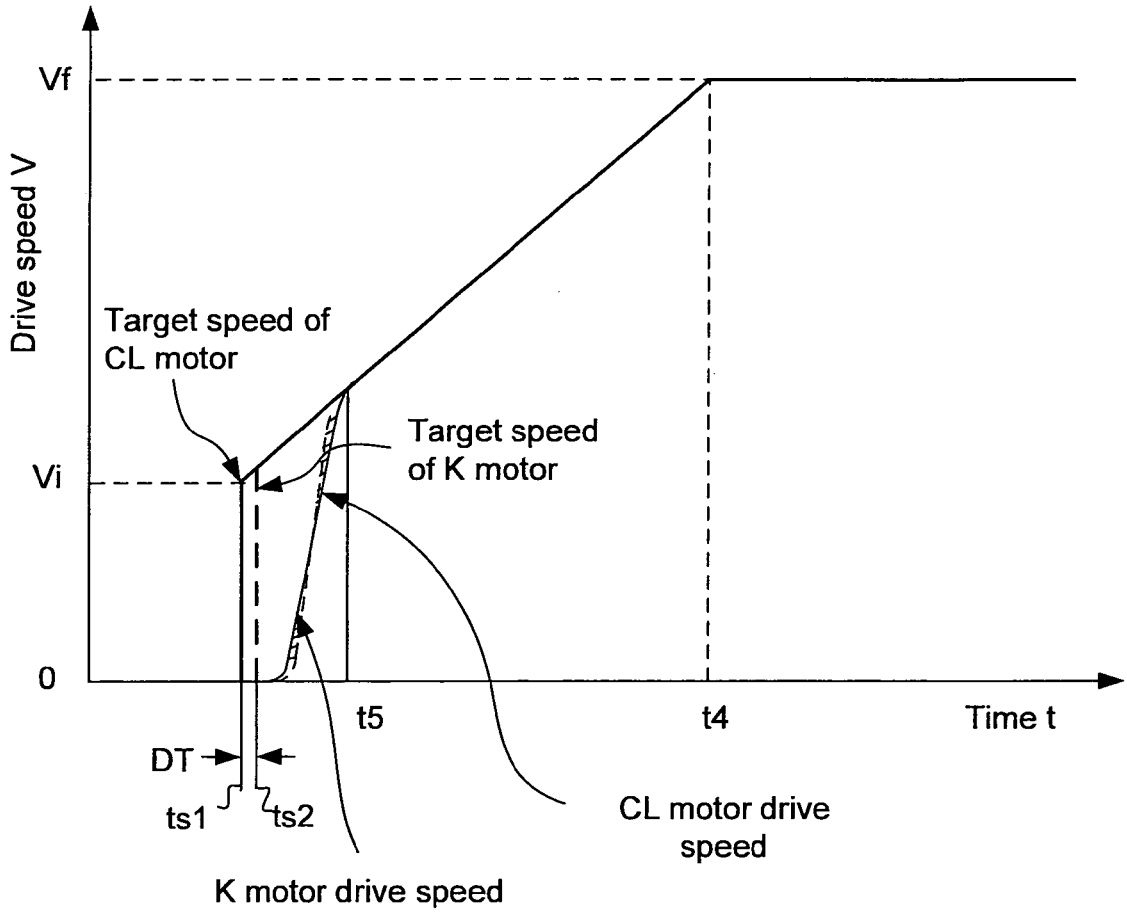
FIG. 5 is a waveform chart illustrating a waveform when a motor for a speed control is started according to an embodiment of the present invention.

The speed control, which is the greatest feature of the present invention, will be described next. FIG. 5 is a waveform chart illustrating the waveform when the motor for the speed control is started according to the present embodiment.

As shown in FIG. 5, the drive control section 25 starts the CL motor 21 at a time ts1 with the target speed indicated by a solid line. Specifically, the target speed of the CL motor 21 is an initial drive speed Vi at the time ts1, and then, the target speed linearly increases to keep a constant image-forming speed Vf at a time t4. In response to this, the actual rotation of the CL motor 21 changes as indicated by a curve of a solid line. The drive control section 25 also starts the K motor 22 at a time ts2 with the target speed indicated by a broken line. Specifically, the target speed of the K motor 22 is zero until the time ts2, and after the time ts2, the target speed of the K motor 22 agrees with the target speed of the CL motor 21. The time ts2 is later than the time ts1 by DT. In response to this, the actual rotation of the K motor 22 changes as indicated by a curve of a broken line.

The startup delay time DT is a predetermined period according to an experiment. In the present embodiment, the startup delay time DT is 5 ms. The experiment is carried out as follows. Specifically, the CL motor 21 and the K motor 22 are started with the target speed shown in FIG. 5, the change in the misregistration in the rotational phases before and after the startup is measured plural times by means of plural apparatuses, and the result of the measurement is statistically processed to determine the value. The detailed condition of the experiment is as described below. The initial drive speed Vi is 52.1 mm/s in terms of the peripheral speed of the photoconductor drum 3. The process speed Vf is 225 mm/s in terms of the peripheral speed of the photoconductor drum 3.

The startup delay time DT may be corrected in accordance with the cumulative rotating time of each photoconductor. Specifically, one cause of the rotational load to rotate the photoconductor lies in a friction force caused by the contact of the cleaning blade of the cleaning unit 65 to the surface of the photoconductor drum 3. The friction force depends upon the surface state of the photoconductor drum 3 and the state of the edge of the cleaning blade. The photoconductor and the cleaning blade are consumable components that are periodically exchanged. Therefore, load torque changes in accordance with the cumulative rotating time in which the photoconductor drum 3 rotates after they are exchanged. In view of this, the optimum value of the DT may be obtained beforehand according to the experiment based on the color cumulative rotating time and the cumulative rotating time of the K photoconductor drum 3K, and the result may be prepared as a data table that can be referred to by the drive control section 25.

When a phase difference of the photoconductors is measured by means of a phase detecting section, the value of the startup delay time with respect to the phase difference may be obtained beforehand from the experiment in order that the optimum startup delay time DT can be determined according to the phase deviation obtained by the measurement, and the result may be prepared as a data table that can be referred to by the drive control section 25. Specifically, the startup delay time DT may be corrected in accordance with the phase misregistration.

By way of example, load torque for the respective motors will be described below. For example, load torque for the K motor 22, i.e., drive torque needed for the K motor 22 during rotation is 60 mN·m, while load torque for the CL motor 21, i.e., drive torque needed for the CL motor 21 during rotation is 100 mN·m.

Since the CL motor 21 is started before the K motor 21, the rotational phases of the photoconductor drums 3Y, 3M, and 3C advance more than the rotational phase of the photoconductor drum 3K at the time when the photoconductor drum 3K starts to rotate. However, the rising of the revolution of the CL motor 21 until the CL motor follows the target speed is gentler than that of the K motor 22. Therefore, after the startup of the photoconductor drum 3K, the advance of the phases of the photoconductor drums 3Y, 3M, and 3C to the photoconductor drum 3K gradually decreases. According to the present embodiment, the startup delay time DT is determined such that, when the CL motor 21 and the K motor 22 follow the target speed (time t5 in FIG. 5), the rotational phases of the photoconductor drums 3Y, 3M, and 3C and the rotational phase of the photoconductor drum 3K are matched with one another. Thereafter, the photoconductor drums 3Y, 3M, 3C, and 3K accelerate with the same phases as rotating, and then, reach the process speed Vf that is a steady-state revolution.

<Procedure of Drive Control Section>

Figure 16:
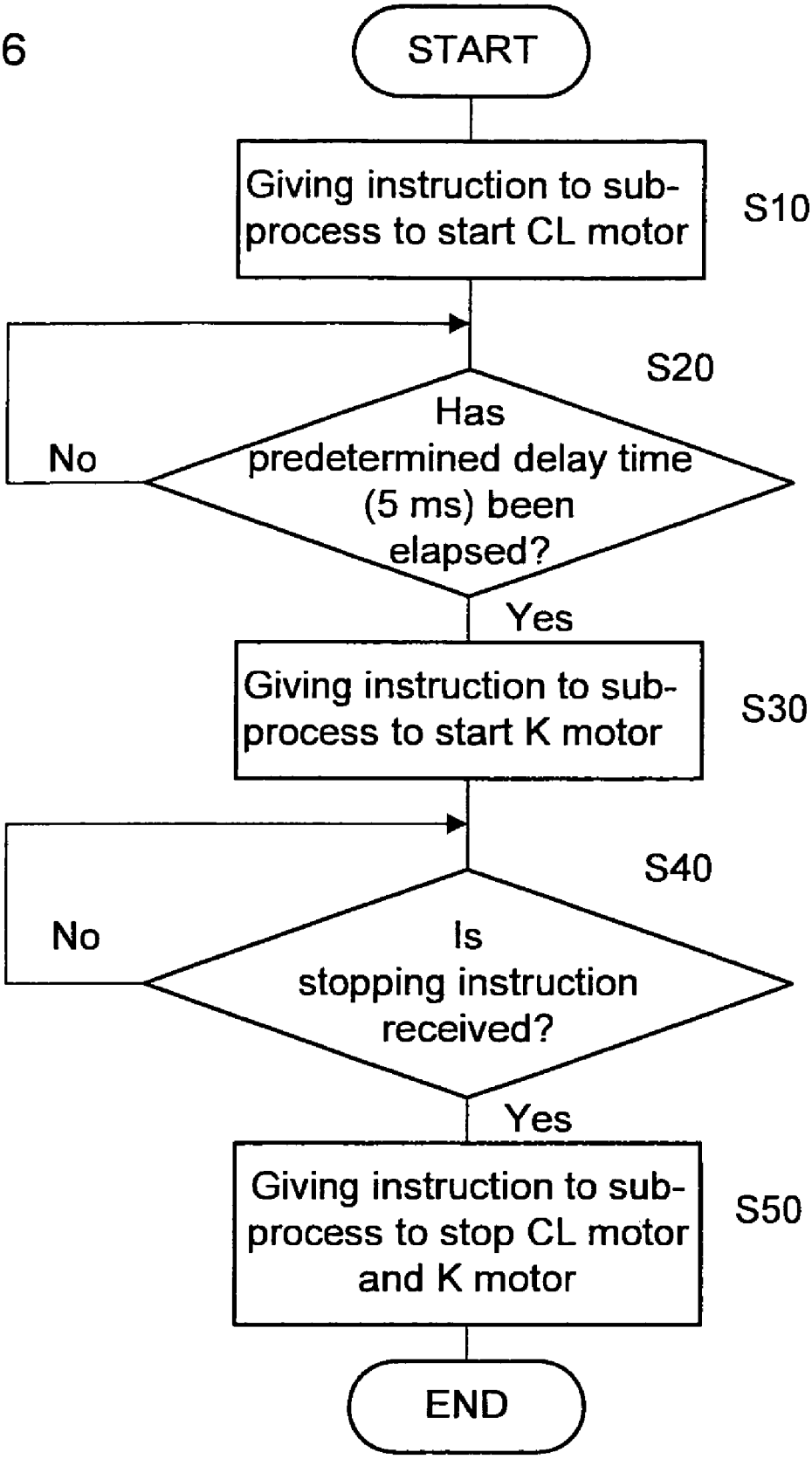
FIG. 16 is a flowchart illustrating a procedure of a process executed by the drive control section in an embodiment of the present invention.

The procedure of the process by the drive control section 25 will be described below. FIG. 16 is a flowchart showing the procedure of the process executed by the drive control section 25 in the present embodiment. In FIG. 16, when the drive control section 25 externally receives the instruction for starting the image formation, it responds to the instruction, so that it sends a command to a later-described sub-process so as to start the rotation of the CL motor (step S10). The external instruction includes, for example, an instruction from the main control section to the drive control section 25. Alternatively, the CPU in the drive control section 25 executes a process program as the main control section, which means the CPU also functions as the main control section. The timing when the CL motor starts its rotation corresponds to the time ts1 in FIG. 5. The sub-processes are independently started in order to control the rotation of the K motor and the rotation of the CL motor, and they are programs that are simultaneously processed according to a time-sharing of CPU-time. The detailed control of the rotation is executed by the later-described sub-processes.

After the CL motor 21 starts to rotate, the drive control section 25 waits (WAIT) for a predetermined time (5 ms) (step S20), and then, sends a command to the sub-process for controlling the K motor in order to start the rotation of the K motor 22 (step S30). The WAIT time in step S20 corresponds to the DT in FIG. 5, and the time when the K motor 22 is started at step S30 corresponds to the time ts2 in FIG. 5.

Thereafter, when the drive control section 25 receives an instruction to stop from the main control section, it sends a command to the sub-processes for controlling the respective motors in order to stop the CL motor 21 and the K motor 22 (step S40).

Figure 6:
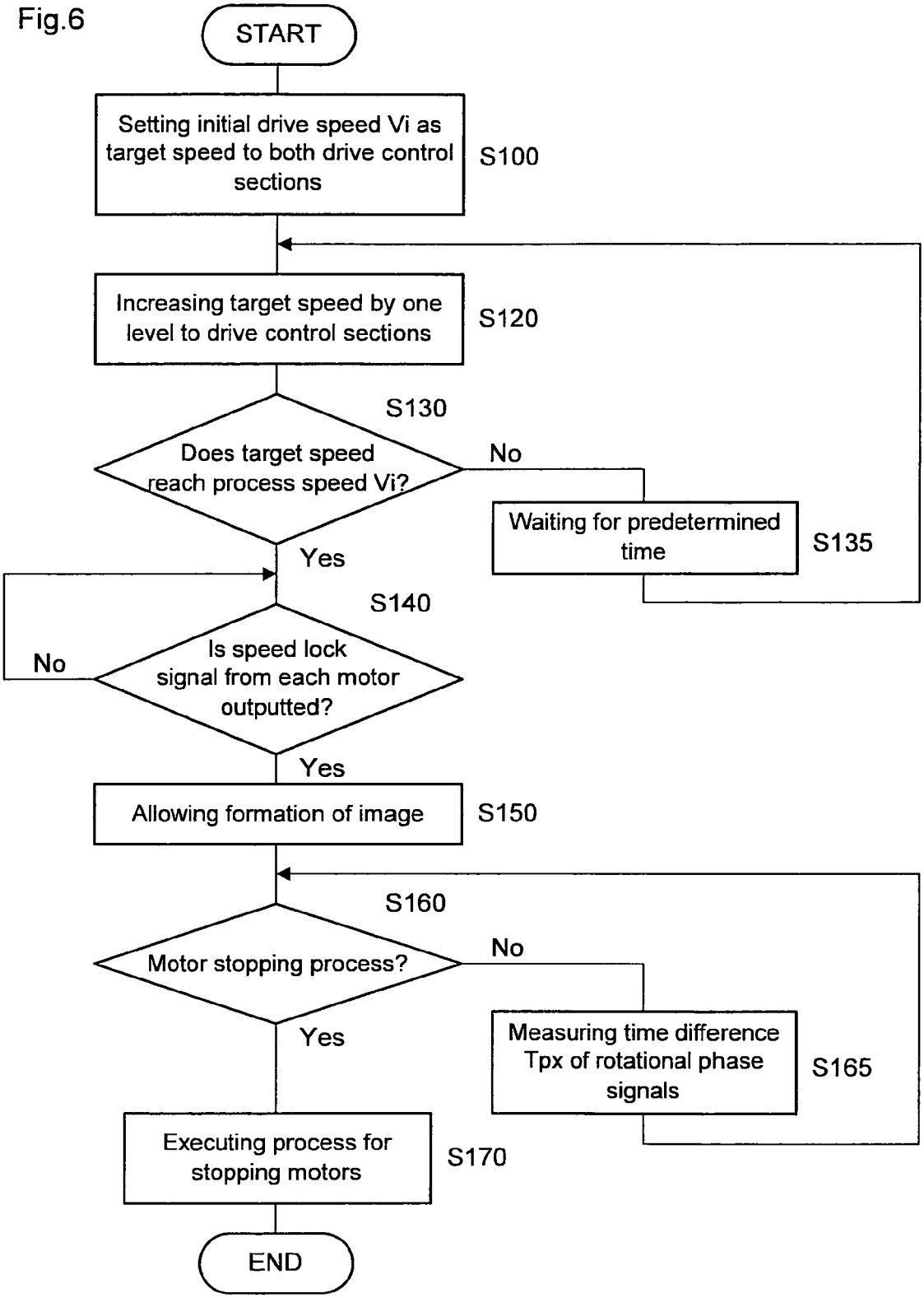
FIG. 6 is a flowchart illustrating a procedure of the drive control section when the motor is started according to an embodiment of the present invention.

FIG. 6 is a flowchart showing a procedure (sub-process) of the drive control section 25 in the drive control for each motor. Two sub-processes, which are the sub-process that is a drive control for the K motor and the sub-process that is the drive control for the CL motor, will be described with reference to the flowchart below. The respective procedures will be described with reference to the corresponding flowcharts.

During the execution of the sub-process, the drive control section 25 sends a starting signal to the CL motor drive control circuit 23 (during the execution of the sub-process for the K motor, it is a K motor drive control circuit 24. The description in the parenthesis indicates the control for the K motor 22 below), and further, sets a target speed to the motor drive control section (step S100). As for the start of the CL motor 21, the initial drive speed Vi is set as the target speed. As for the start of the K motor 22, the speed that is equal to the target speed of the CL motor 21 at the present is set as the target speed.

The initial drive speed Vi is the value by which the CL motor 21 can be started, and within a settable range in the circuit specification.

In response to the instruction at step S100, the CL motor drive control circuit 23 (K motor drive control circuit 24) starts both motors with the set target speed.

Then, the drive control section 25 serving as the respective sub-processes starts a ramp-up process for sequentially increasing the target speed to the process speed Vf. Specifically, the drive control section 25 increases the target speed in predetermined increments to the CL motor drive control circuit 23 (K motor drive control circuit 24) (step S120). Then, the drive control section 25 determines whether or not the target speed reaches the process speed Vf that is the final target value (step S130). When the target speed does not reach the final target, the drive control section 25 proceeds to the step S120 after waiting for a predetermined time (step S135). The waiting time is set beforehand as the time that each motor can follow the change in the target speed. The drive control section 25 further increases the target speed in predetermined increments at step S120. Thereafter, the process loop of the steps S135, S120, and S130 is repeated until the target speed reaches the process speed Vf. The target speed increases by the repeated process. This corresponds to the period from the time ts1 (ts2) to the time t4 in FIG. 5. When the target speed reaches the process speed Vf as the result of the determination at the step S130, the drive control section 25 continues the speed control with the process speed Vf defined as the target. This corresponds to the time t4 in FIG. 5.

The drive control section 25 waits for the output of the speed lock signal from each of the motor drive control sections (step S140), and allows the main control section, which controls the entire operation of the image forming apparatus 100, to start the image formation (step S150). The drive control section and the main control section may be realized by a separate hardware resource (a CPU, a ROM that stores a process program executed by the CPU, a RAM that provides a work area, etc.), or may be realized by a common hardware resource.

The drive control section 25 measures a time difference Tpx between the rotational phase signal for the cyan photoconductor drum 3C and the rotational phase signal for the black photoconductor drum 3K during the image forming process. The measurement of the time difference Tpx of the rotational phase signal will be described later.

After the image formation is completed, the main control section gives an instruction to the drive control section 25 to stop the motors. The drive control section 25 executes a process of stopping both motors in response to the instruction for the stop (step S170). Specifically, the drive control section 25 sends a stop signal to the CL motor drive control circuit 23 (the K motor drive control circuit 24). Further, the drive control section 25 corrects the rotational phases of the photoconductor drums during the stopping process. The correction of the rotational phases will be described in detail later.

<Detection of Rotational Phase of Photoconductor Drum>

The method of detecting the rotational phases of the photoconductor drums will next be described.

FIG. 7 is an explanatory view illustrating the configuration of the sections serving as a phase detecting section involved with the detection of the rotational phases of the photoconductor drums in the present embodiment. Specifically, FIG. 7 shows the cyan photoconductor drum 3C, the photoconductor-drum drive gear 41C, the idle gear 43*b* that is engaged with the photoconductor-drum drive gear 41C, the C photoconductor phase sensor 27, and the projecting portion 45C corresponding to the C photoconductor phase sensor 27, those of which are viewed from the direction orthogonal to the rotational axis of the photoconductor drum 3C. As illustrated in FIG. 7, the C photoconductor phase sensor 27 that generates the C rotational phase signal in order to detect the rotational phase is arranged so as to correspond to the photoconductor drum 3C. The projecting portion 45C is formed at the portion that rotates integral with the photoconductor drum 3C. The C photoconductor phase sensor 27 is fixed to the body. Every time the photoconductor drum 3C makes one rotation, the projecting portion 45C passes a detecting portion. In this case, the C photoconductor phase sensor 27 outputs the C rotational phase signal. A photo interrupter can be employed as the C photoconductor phase sensor 27, for example.

The C rotational phase signal is inputted to the drive control section 25.

The detection of the rotational phase of the black photoconductor drum 3K is performed in the same manner.

In the present embodiment, the YMC photoconductors are adjusted in order not to produce the misregistration in the rotational phases thereof upon the manufacture. After the adjustment, the YMC photoconductors are engaged with the input gears and the idle gears, so that there is no chance that the misregistration in the phases occurs during the operation. Accordingly, only the projecting portions formed at an end of the cyan (C) photoconductor and at an end of the black (BK) photoconductor are detected by the phase sensors, and the misregistration is corrected based on a time difference in the rotational phase signals of both phase sensors.

<Correction of Rotational Phase of Photoconductor Drum>

The procedure of correcting the rotational phases of the photoconductor drums will be described.

Figure 9:
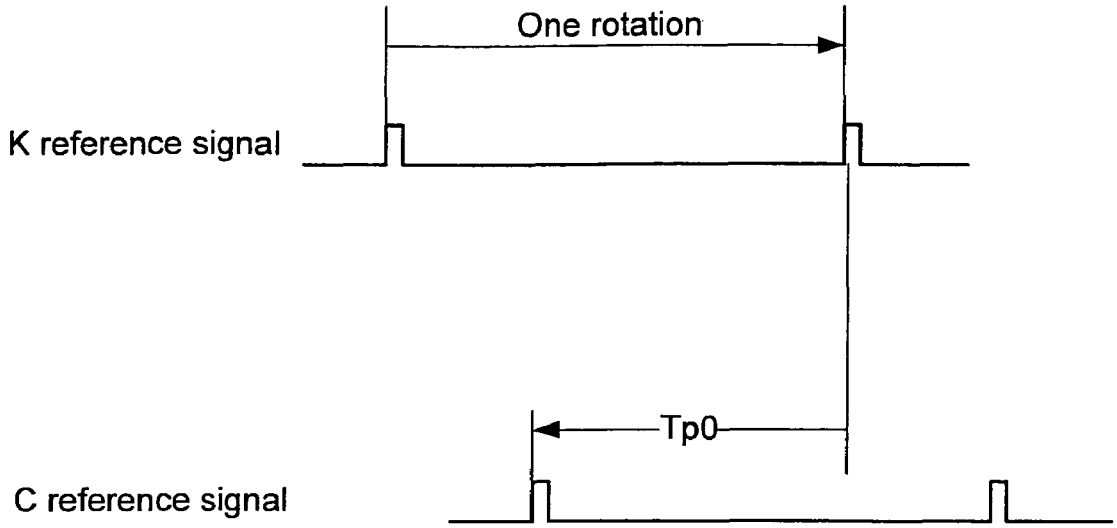
FIG. 9 is a waveform chart illustrating one example of a waveform of a rotational phase signal from a phase sensor according to an embodiment of the present invention.

Firstly, the rotational phases of the photoconductor drums 3C and 3K are adjusted to be matched during the manufacture of the apparatus. A time difference Tp0 of the rotational phase signals of the photoconductor drums 3C and 3K with the phases being matched after the adjustment is measured, and stored. In the present embodiment, the delay and the advance of the photoconductor drum 3C are stored with the photoconductor drum 3K defined as a reference. FIG. 9 is a waveform chart illustrating one example of a waveform of the rotational phase signal from the phase sensor in the present embodiment. The time Tp0 is the reference for correcting the rotational phase.

On the other hand, as described in the explanation of step S165 in the flowchart in FIG. 6, the time difference Tpx of the rotational phase signal of the photoconductor drum 3C and the rotational phase signal of the photoconductor drum 3K is measured during the rotation of the photoconductor drums 3 for the respective colors. The measured time difference Tpx is compared to the reference time Tp0, whereby it can be determined whether the misregistration in the phases occurs or not. If the time Tpx is deviated more than the allowable range as a result of the comparison to the time Tp0, the rotational phases of the photoconductor drums are corrected for correcting the misregistration amount a.

Figure 8A:
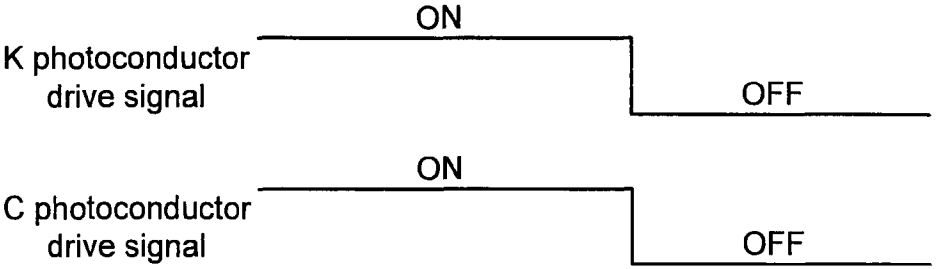
FIGS. 8A to 8C are waveform charts, each illustrating a state of correcting a misregistration in a rotational phase of a photoconductor the according to an embodiment of the present invention.
Figure 8B:
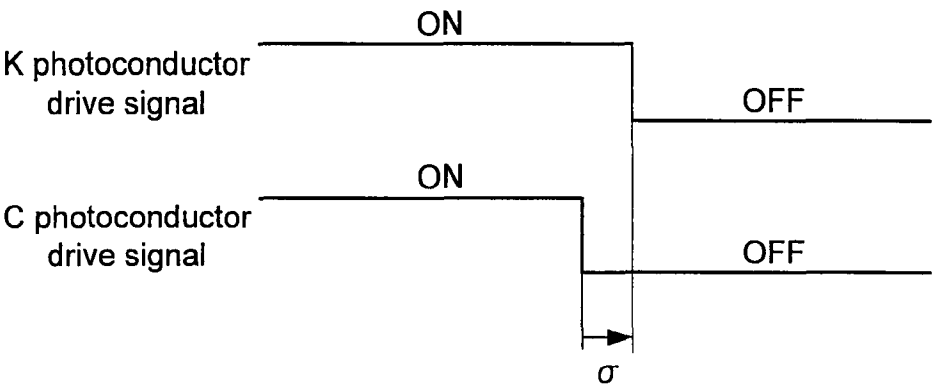
Figure 8C:
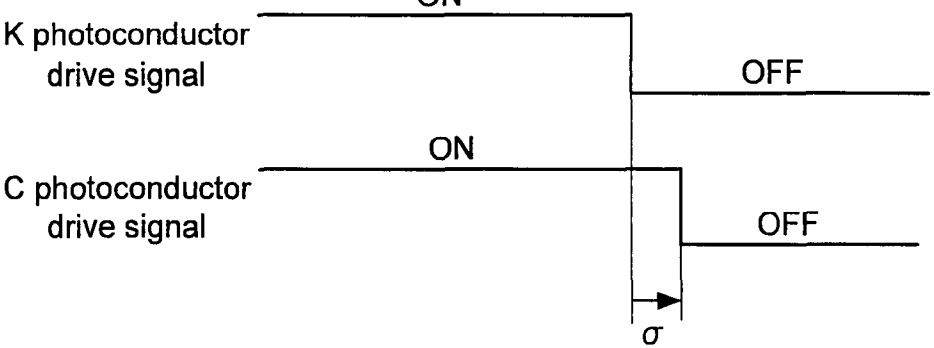

FIGS. 8A to 8C are waveform charts illustrating a state in which the misregistration in the rotational phases of the photoconductor drums is corrected.

When the phases of the photoconductor drums are matched, i.e., when a difference between the time Tpx and the time Tp0 is within a predetermined range, the drive control section 25 simultaneously stops the photoconductor drum 3K and the photoconductor drum 3C. During the normal use, both phases are matched, so that the drive control section 25 simultaneously stops both drums (see FIG. 8A).

When the black printing is performed, the black photoconductor drum 3K is stopped with the rotational phase n rotations (n is an integer) after the photoconductor drum 3K is started, whereby the black photoconductor drum 3K can be stopped without changing the relationship between the phases of the black photoconductor drum 3K and the cyan photoconductor drum 3C.

If the phase of the photoconductor drum 3C advances more than the phase of the photoconductor drum 3K from the reference by the time σ, the photoconductor drum 3C is stopped earlier than the photoconductor drum 3K by the time σ, whereby the misregistration in the rotational phases of both photoconductor drums can be corrected (FIG. 8B).

On the contrary, if the phase of the photoconductor drum 3C delays more than the phase of the photoconductor drum 3K from the reference by the time σ, the photoconductor drum 3C is stopped later than the photoconductor drum 3K by the time σ (the photoconductor drum 3C is driven too much), whereby the misregistration in the rotational phases of both photoconductor drums can be corrected (FIG. 8C).

Any one of the photoconductor drums is stopped by performing the correction of σ in the same manner n rotations (n is an integer) after it is stopped, whereby the rotational phases can be corrected.

The rotational phases are corrected in the same manner in case where the photoconductor drums 3Y, 3M, 3C, and 3K are driven by the respective independent drive sources.

<Modification of Speed Control>

A different embodiment of the speed control will be described below.

Figure 17:
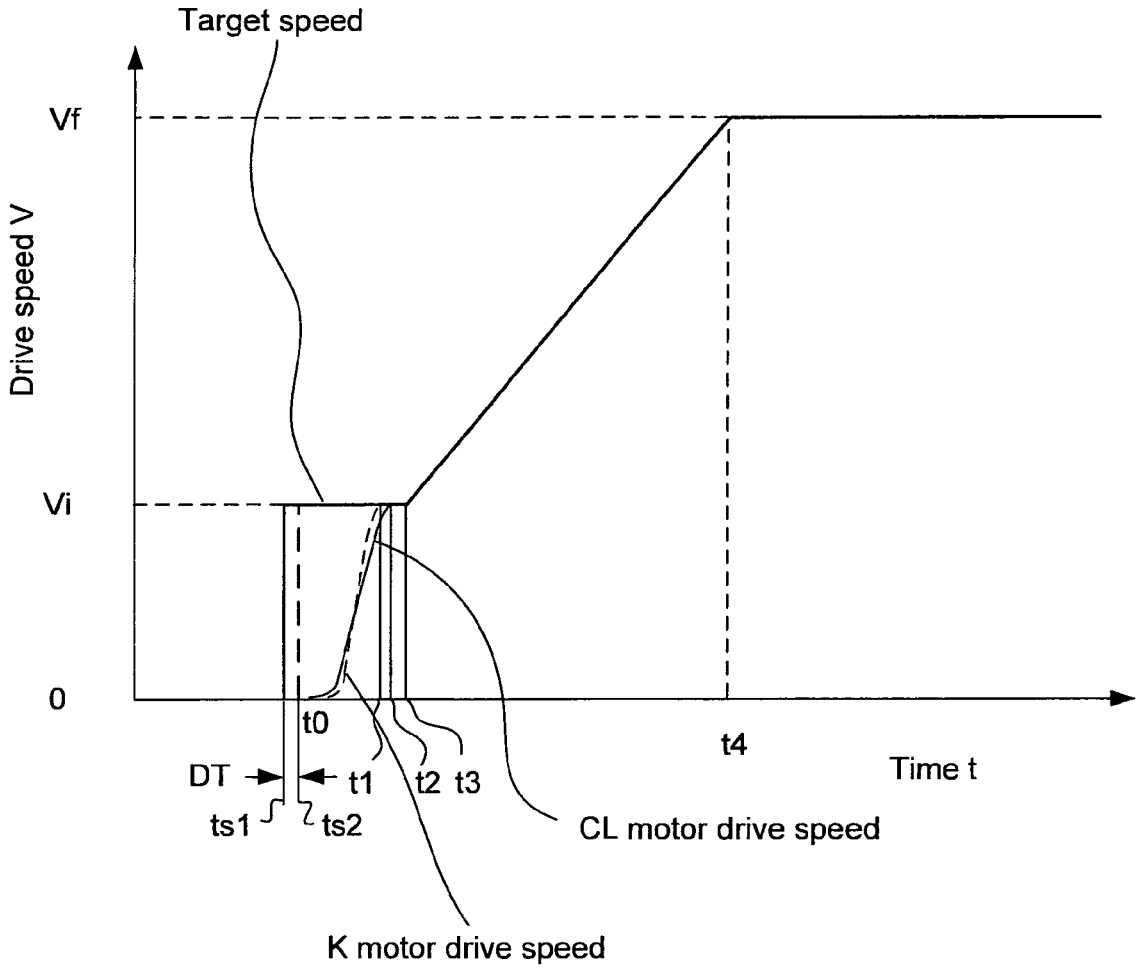
FIG. 17 is a second waveform chart illustrating a waveform when motors are started during the speed control according to an embodiment of the present invention.

FIG. 17 is a second waveform chart indicating a waveform when motors are started during the speed control according to the present embodiment.

Figure 10:
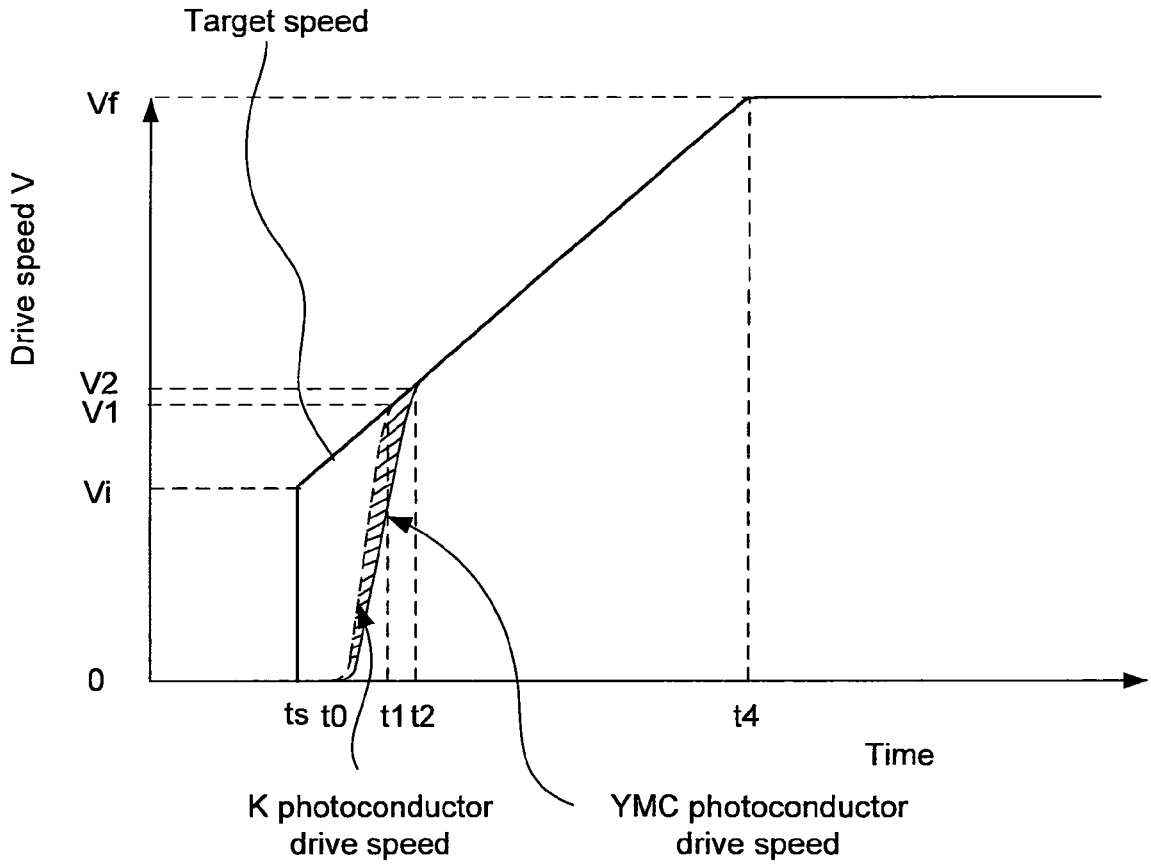
Fig.10 PRIOR ART
FIG. 10 is a waveform chart illustrating a speed control when the photoconductor drum, which is stopped, is started by means of a DC motor serving as a drive source in a conventional image forming apparatus.

According to the present embodiment, when the CL motor 21 and the K motor 22 are started, the target value of the drive speed is set to the initial drive speed Vi upon the startup, like the conventional waveform shown in FIG. 10. However, the waveform in the present embodiment is different from the conventional waveform in that the target value of the drive speed is maintained to be Vi until the time t3. It is supposed that the initial drive speed Vi is equal to the initial drive speed Vi in the conventional waveform in FIG. 10. The initial drive speed Vi is set by a designer as a value that is well great by which the CL motor 21 and the K motor 22 can overcome the static friction force to be started.

The starting time of the CL motor is set to the ts1, while the starting time of the K motor is set to the time ts2 that is delayed by a predetermined time.

During when the target speed is kept to be the initial drive speed Vi, the output from the set comparing circuit 33 gives an instruction to the current limitation circuit 33 so as to supply the current, according to the misregistration with respect to the target speed, to the motor. Thereafter, the driving force of the motor overcomes the static friction force, so that the motors start to rotate at the time t0. Then, the rotating speed of each motor sharply increases to the initial drive speed Vi. The drive speed of the K photoconductor drum reaches the target speed at the time t1. On the other hand, the drive speeds of the YMC photoconductors reach the target speed at the time t2, which is slightly later than the time t1, since a load is heavier than the K photoconductor. As described above, the K photoconductor slightly sharply accelerates compared to the YMC photoconductors, because of a difference in a drive load between the YMC photoconductors and the K photoconductor.

However, a time difference between the K photoconductor and the YMC photoconductors is small. Because the target speed is lower than the speeds V1 and V2 in FIG. 10. A region of the product of the time taken to reach the initial drive speed Vi from the starting time t0 and the speed (an area of an internal region enclosed by the lines linking a point where the time is t0 and the target speed is zero, a point where the time is t1 and the target speed is Vi, and a point where the time is t2 and the target speed is Vi) is smaller than that in the conventional waveform. Specifically, a difference in the rotational phases between the K photoconductor drum and the YMC photoconductors upon the startup is more suppressed than in the conventional waveform.

When the CL motor 21 reaches the target speed, the speed lock signal is outputted from the CL motor drive control circuit 23 to the drive control section 25. When the K motor 22 reaches the target speed, the speed lock signal is outputted from the K motor drive control circuit 24 to the drive control section 25. When the drive control section 25 recognizes that these speed lock signals are outputted (time t3), the drive control section 25 sequentially increases the target speed to the process speed Vf.

According to the study of the present inventors, after the CL motor 21 and the K motor 22 reach the target speed (after the times t1 and t2), the speeds of both motors are controlled along the target speed. In the conventional speed control shown in FIG. 10, the speeds of both motors are also controlled along the target speed after the times t1 and t2. Accordingly, it is considered that the misregistration in the rotational phases between the YMC photoconductor drums and the K photoconductor drum from the start to the stop is greatly improved by improving the misregistration in the rotational phases at the starting when the motors are activated.

According to the present embodiment, the motors are started as the target speed is kept to be the initial drive speed Vi by which the motors can be started. Even if the target speed is increased after the drive speed of each motor temporarily reaches the initial drive speed Vi, the motors correctly follow the target speed, compared to the period (the period from the time ts1 to the time t1 and the period from the time ts2 to the time t2) before the drive speed reaches the initial drive speed Vi. Therefore, the misregistration in the rotational phases is suppressed, compared to the conventional technique.

The procedure of a sub-process in the present embodiment will be described. The drive control section 25 similarly executes the procedure shown in FIG. 16 in this embodiment, but the sub-processes are different from those in FIG. 16.

Figure 18:
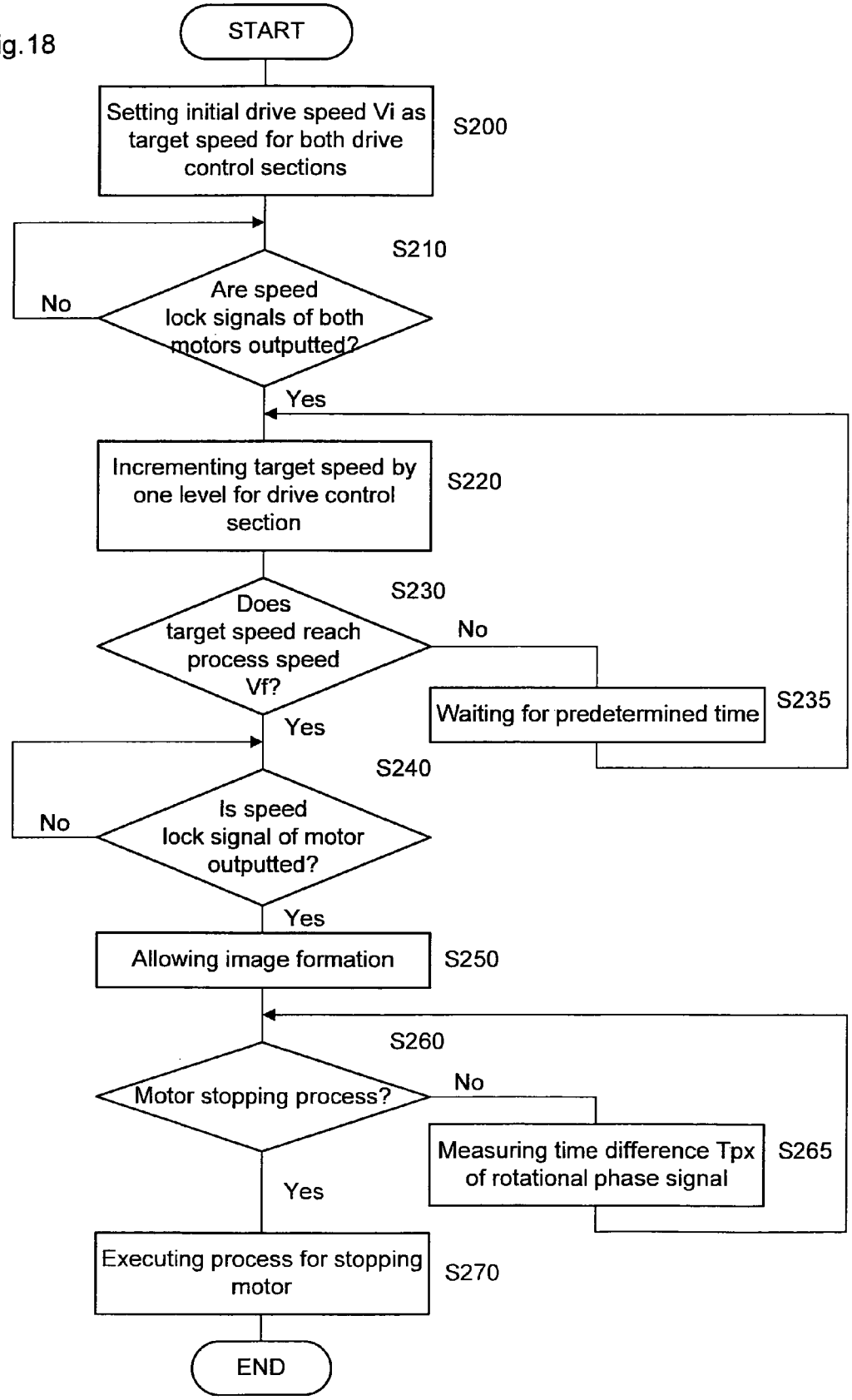
FIG. 18 is a flowchart illustrating a sub-process according to an aspect of an embodiment of the present invention.

FIG. 18 is a flowchart of the sub-processes in the present embodiment. As can be understood from the comparison between FIG. 6 and FIG. 18, the flowchart in FIG. 18 includes step S210 that does not correspond to FIG. 6. The other steps correspond to those in FIG. 6. Specifically, step S100 in FIG. 6 corresponds to step S200 in FIG. 18. Further, step S120 in FIG. 6 corresponds to step S220 in FIG. 18. Specifically, steps in FIG. 6 correspond to the steps in FIG. 18 whose step numbers are obtained by adding 100 to the step numbers in FIG. 6.

The step S210 that is not included in FIG. 6 will be described.

When the drive speed of each motor follows the target speed, the CL motor drive control circuit 23 and the K motor drive control circuit 24 output the speed lock signal respectively. The drive control section 25 waits for the output of these speed lock signals (step S210). After it is detected that the speed lock signals are outputted for both motors (Yes at step S210), the drive control section 25 starts a ramp-up process for increasing the target speed to the process speed Vf from the initial drive speed Vi. This corresponds to the time t3 in FIG. 5.

According to the process at step S210, the target speed is kept to be Vi until the CL motor 21 and the K motor 22 reach the initial target speed Vi, and after the both motors reach the target speed, the ramp-up process is started, as illustrated in FIG. 17.

What is claimed is:

1. An image forming apparatus comprising:

a black-color-purposed photoconductor for forming a black-color image;

a plurality of full-color-purposed photoconductors for forming a full-color image together with the black-color-purposed photoconductor;

a first drive section for driving to rotate the black-color-purposed photoconductor;

a second drive section for driving to rotate the plurality of full-color-purposed photoconductors;

a drive control section for controlling the first and the second drive sections, wherein each photoconductor constituting the black-color-purposed photoconductor and the plurality of full-color-purposed photoconductors is engaged to the first drive section or the second drive section with rotational phases thereof being matched with one another;

the drive control section controls the first and the second drive sections so that the first drive section is activated to make the black-color-purposed photoconductor start rotating by a predetermined delay time after the second drive section is activated to make the plurality of full-color-purposed photoconductors start rotating; and the predetermined delay time is a predetermined time based on a time difference which is measured between a start time of the first drive section and that of the second drive section when the first and the second drive sections are activated at a target speed for forming the full-color image.

2. The image forming apparatus according to claim 1, wherein the target speed for forming the full-color image is the final speed.

3. The image forming apparatus according to claim 1, further comprising:

a phase detecting section for detecting the rotational phases of the black-color-purposed photoconductor and the plurality of full-color-purposed photoconductors; and a rotational phase correcting section for determining whether the rotational phases thereof are matched with one another or not based on detection by the phase detecting section, and corrects the rotational phases of the black-color-purposed photoconductor and/or the plurality of full-color-purposed photoconductors according to the determination thereof, wherein the phase detecting section obtains misregistration in the rotational phases between the photoconductors when each of the photoconductors rotates with the final speed for the full-color image formation, and corrects the predetermined delay time thereafter, based on the misregistration.

4. The image forming apparatus according to claim 1, further comprising:

a counting section for counting a cumulative rotating time of each photoconductor, wherein the drive control section corrects the predetermined delay time in accordance with the counted cumulative rotating time.

5. The image forming apparatus according to claim 1, wherein the drive control section controls so that a rotational phase of the black-color-purposed photoconductor at a time when the black-color-purposed photoconductor starts rotating matches with a rotational phase thereof at a time when it stops rotating, when a black-color image is formed.

6. The image forming apparatus according to claim 1, wherein each of the photoconductors is used for forming a toner image of a different color component, the black-color-purposed photoconductor is used for forming a black toner image, and the plurality of full-color-purposed photoconductors constituting three photoconductors: are used for forming a yellow toner image, a cyan toner image, and a magenta toner image, respectively.

7. The image forming apparatus according to claim 1, wherein each of the first and the second drive sections includes a DC motor for driving the corresponding photoconductors, respectively.

8. The image forming apparatus according to claim 1, further comprising:

a plurality of image forming sections for forming toner images on the photoconductors, each of the image forming sections forming a toner image on different photoconductors, wherein the first drive section drives image forming section(s) which forms/form the toner image(s) on the photoconductor(s) of the black-color-purposed photoconductor and the second drive section drives image forming section(s) which forms/form the toner image(s) on the photoconductor(s) of the plurality of full-color-purposed photoconductors, and each of the image forming sections includes at least a developing section.

9. The image forming apparatus according to claim 3, wherein the rotational phase correcting section detects whether the rotational phases thereof are matched with one another or not at a predetermined timing, and allows the drive control section to correct the rotational phase of the black-color-purposed and/or the plurality of full-color-purposed photoconductors when the rotational phase correcting section determines that the rotational phases are not matched.

10. The image forming apparatus according to claim 9, wherein the rotational phase correcting section ignores the detections of the phase detecting section in the period from the starting of the black-color-purposed photoconductor and the plurality of full-color-purposed photoconductors to their reaching the final speed and determines whether the rotational phases thereof are matched or not based on the detections of the phase detecting sections after the reaching.

11. The image forming apparatus according to claim 1, wherein the drive control section controls the first and second drive sections at an initial target drive speed lower than the target speed determined for forming the full-color image and subsequently, controls the first and second drive sections by changing the initial target drive speed to the target speed for forming the full-color image.

* * * * *